US012709812B2

(12) United States Patent
Moon et al.

(10) Patent No.: US 12,709,812 B2
(45) Date of Patent: Aug. 18, 2026

(54) POROUS NANOPARTICLE CATALYST FOR METHANE CONVERSION AND METHOD OF PREPARING THE SAME

(71) Applicant: SOGANG UNIVERSITY RESEARCH & BUSINESS DEVELOPMENT FOUNDATION, Seoul (KR)

(72) Inventors: Jun Hyuk Moon, Seoul (KR); Jaehyun Lee, Seoul (KR); Jiwoo Yang, Seoul (KR)

(73) Assignee: SOGANG UNIVERSITY RESEARCH & BUSINESS DEVELOPMENT FOUNDATION, Seoul (KR)

( * ) Notice: Subject to any disclaimer, the term of this patent is extended or adjusted under 35 U.S.C. 154(b) by 995 days.

(21) Appl. No.: 17/567,958

(22) Filed: Jan. 4, 2022

(65) Prior Publication Data

US 2022/0228278 A1 Jul. 21, 2022

(30) Foreign Application Priority Data

Jan. 18, 2021 (KR) ..... 10-2021-0006780

(51) Int. Cl.

| | |
|---|---|
| ***C25B 11/037*** | (2021.01) |
| ***C25B 3/07*** | (2021.01) |
| ***C25B 3/25*** | (2021.01) |
| ***C25B 11/031*** | (2021.01) |
| ***C25B 11/047*** | (2021.01) |
| ***C25B 11/091*** | (2021.01) |

(52) U.S. Cl.

CPC ..... *C25B 11/037* (2021.01); *C25B 3/07* (2021.01); *C25B 3/25* (2021.01); *C25B 11/031* (2021.01); *C25B 11/047* (2021.01); *C25B 11/091* (2021.01)

(58) Field of Classification Search

CPC ..... C25B 11/037; C25B 3/07; C25B 3/25; C25B 11/031; C25B 11/047; C25B 11/091; C25B 3/21; C25B 3/23; C25B 11/052; C25B 11/065; C25B 11/093; C25B 11/077; B01J 21/00; B01J 23/00; B01J 35/51; B01J 35/60; B01J 37/08; B01J 35/40; Y02P 20/52

See application file for complete search history.

(56) References Cited

U.S. PATENT DOCUMENTS

2019/0224650 A1* 7/2019 Park ..... B01J 23/755

FOREIGN PATENT DOCUMENTS

| | | | | |
|---|---|---|---|---|
| CN | 110327934 A | * | 10/2019 | ..... B01D 53/62 |
| KR | 10-2019-0033918 A | | 4/2019 | |
| KR | 10-2019-0036268 A | | 4/2019 | |
| KR | 10-2019-0081121 A | | 7/2019 | |
| KR | 10-2020-0119266 A | | 10/2020 | |

OTHER PUBLICATIONS

Xie et al., "Highly Selective Oxidation of Methane to Methanol at Ambient Conditions by Titanium Dioxide-supported Iron Species" Nature Catalysis 1, Nov. 2018, 889-896 (Year: 2018).*

Chen et al., "Application of in-plasma catalysis and post-plasma catalysis for methane partial oxidation to methanol over a Fe2O3—CuO/γ-Al2O3 catalyst" Journal of Natural Gas Chemistry 19, Nov. 2010, 628-637 (Year: 2010).*

Markoulaki et al., "Synthesis of Ordered Mesoporous CuO/CeO2 Composite Frameworks as Anode Catalysts for Water Oxidation" Nanomaterials 5, Nov. 2015, 1971-1984 (Year: 2015).*

Jobbagy et al., "Synthesis of Copper-Promoted CeO2 Catalysts" Chem. Mater. 18, Mar. 2006, 1945-1950 (Year: 2006).*

Hung, "Study on the Properties and Cytotoxicity Assessment of Nanostructure Copper-Cerium Model Catalysts Prepared by Coprecipitation Approach" Advanced Materials Research 160-162, Nov. 2010, 1291-1296 (Year: 2010).*

Chaparro-Garnica et al., "Design of Monolithic Supports by 3D Printing for Its Application in the Preferential Oxidation of CO (CO-PrOx)" ACS Appl. Mater. Interfaces 11, Sep. 2019, 36763-36773 (Year: 2019).*

Zhijun Zuo et al., Low-Temperature Conversion of Methane to Methanol on CeOx/Cu20 Catalysts: Water Controlled Activation of the C—H Bond, Journal of the American chemical society, 2016, vol. 138, pp. 13810-13813, Oct. 10, 2016.

Allegra A. Latimer et al., Direct Methane to Methanol: The Selectivity-Conversion Limit and Design Strategies, ACS Catalysis, 2018, vol. 8, pp. 6894-6907, Jun. 29, 2018.

* cited by examiner

*Primary Examiner* — Anthony J Zimmer
*Assistant Examiner* — Abdul-Rahman Yusuf Waleed Smari
(74) *Attorney, Agent, or Firm* — Shih IP Law Group, PLLC.

(57) ABSTRACT

THE PRESENT DISCLOSURE RELATES TO A POROUS NANOPARTICLE CATALYST FOR METHANE CONVERSION, INCLUDING A FIRST METAL OXIDE AND A SECOND METAL OXIDE, AND A METHOD OF PREPARING THE SAME.

16 Claims, 33 Drawing Sheets

*FIG. 5A(ii)*

*FIG. 5A(iii)*
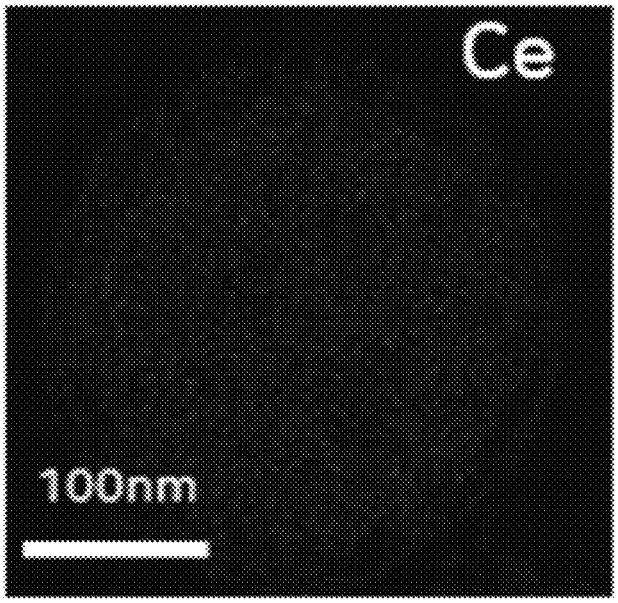
*FIG. 5A(iv)*
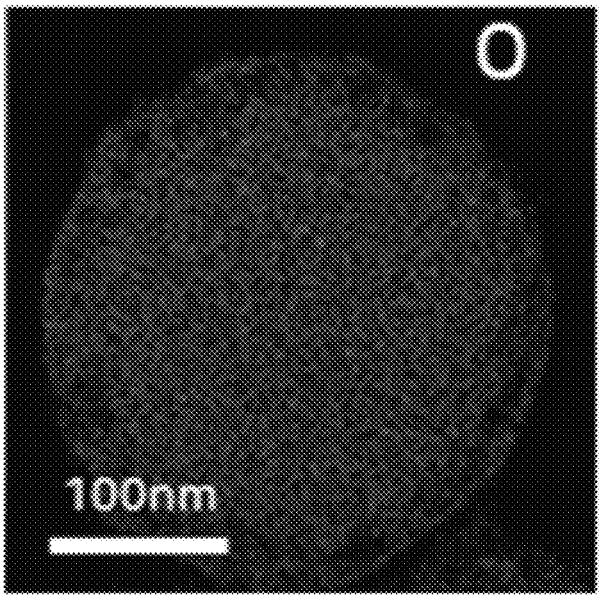

*FIG. 5B(ii)*
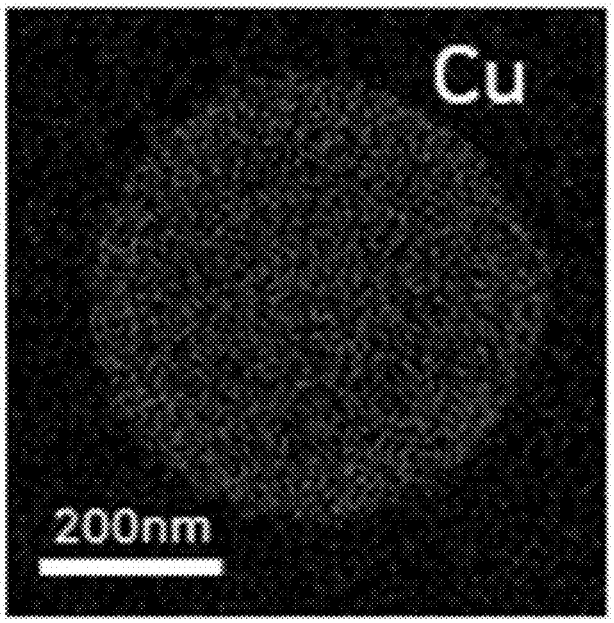
*FIG. 5B(iii)*
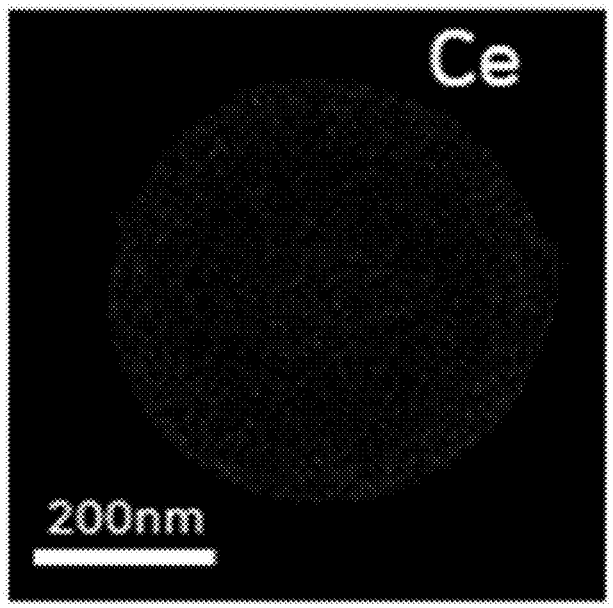

*FIG. 5B(iv)*
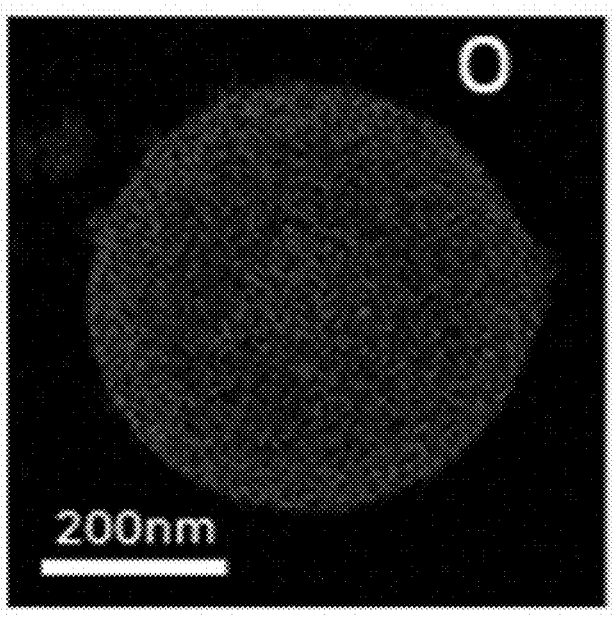
*FIG. 5C(i)*
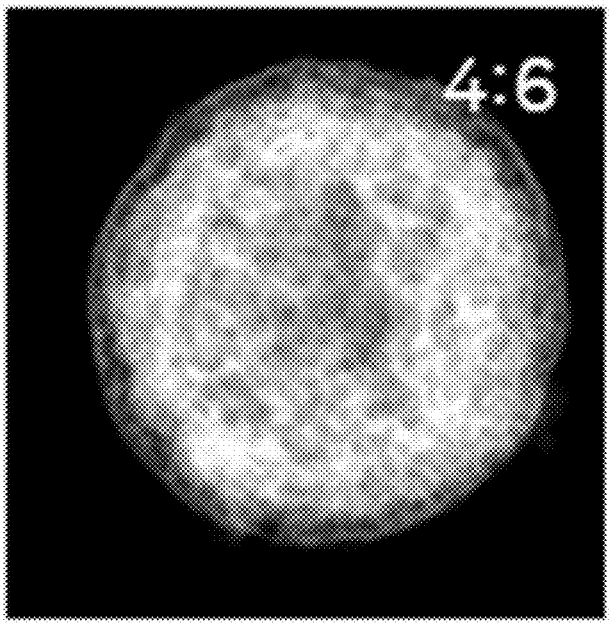

*FIG. 5C(ii)*
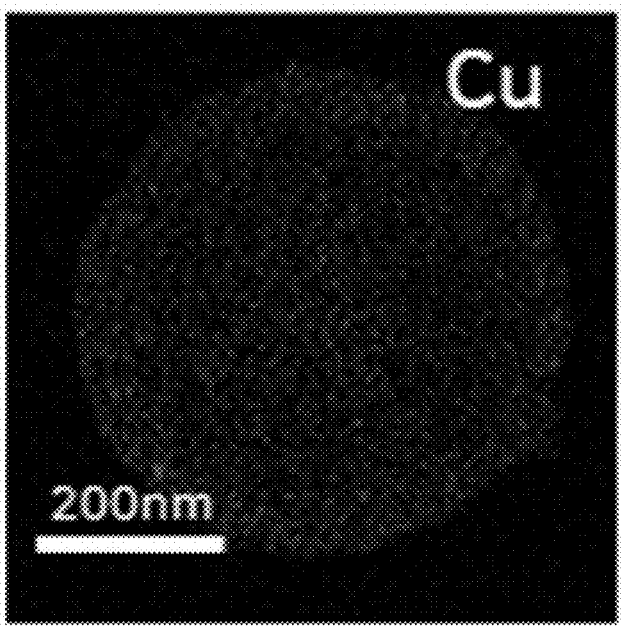
*FIG. 5C(iii)*
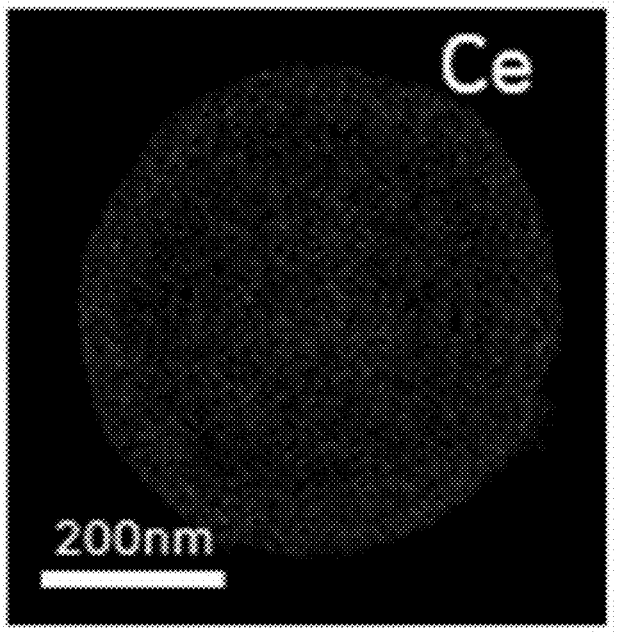

*FIG. 5C(iv)*
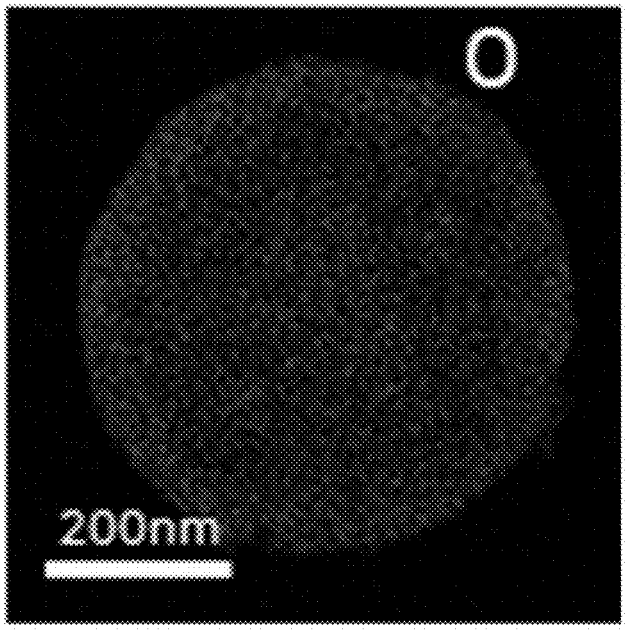
*FIG. 6*
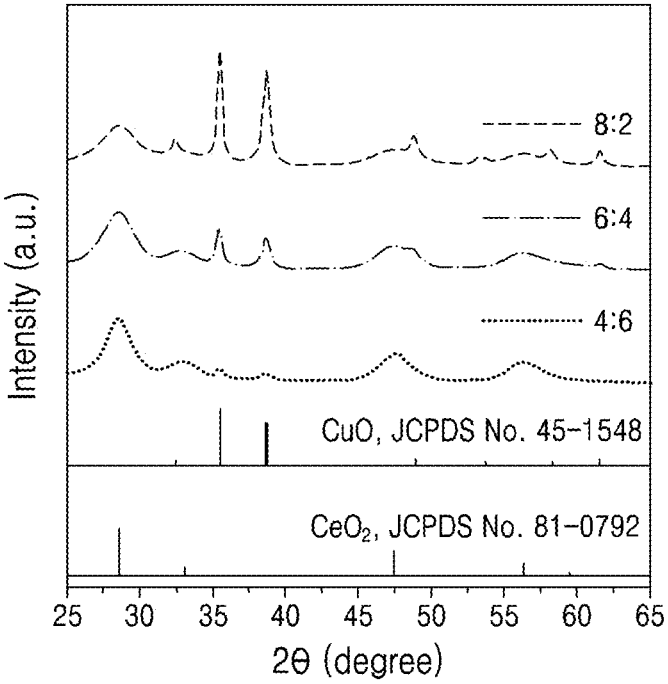

POROUS NANOPARTICLE CATALYST FOR METHANE CONVERSION AND METHOD OF PREPARING THE SAME

CROSS-REFERENCE TO RELATED APPLICATION

This application claims the benefit under 35 USC 119(a) of Korean Patent Applications No. 10-2021-0006780 filed on Jan. 18, 2021 in the Korean Intellectual Property Office, the entire disclosures of which are incorporated herein by reference for all purposes.

TECHNICAL FIELD

The present disclosure relates to a porous nanoparticle catalyst for methane conversion, including a first metal oxide and a second metal oxide, and a method of preparing the same.

BACKGROUND

To solve depletion of fossil fuels resulting from the limited reserves of fossil fuels and global warming caused by the use of the fossil fuels, many countries have recently invested a huge budget for alternative energy development. Particularly, a lot of attention has been given to the applicability of natural gas to use a fossil fuel as an alternative energy source in addition to the development of renewable energy sources such as solar energy. Natural gas produces more energy per carbon dioxide emitted from burning than petroleum or coal, and is abundantly reserved and thus can be stably supplied for the long term. Therefore, it has been evaluated to be the most available alternative material to the fossil fuels and the production of natural gas is steeply increasing every year.

However, the need to use shale gas, which is a new emerging resource, and the need to manage climate change are urgent. Therefore, high-efficiency eco-friendly methane conversion technology has received a lot of attention. Conversion of methane to methanol ($CH_4$—$CH_3OH$) is encouraged because methanol is a fuel and serves as a building block of various raw materials of fine chemical products. The gas phase reaction between methane and oxygen is a direct pathway to produce methanol. Partial oxidation is spontaneous at high temperature, but a competitive reaction to produce $CO_2$ and $H_2$ is thermodynamically favorable at a temperature of about 600 K or more. This makes a perfect trade-off between the conversion of methane and the selectivity for methanol. As a result, the pathway has not yet been established as a commercialized process.

Nørskov proposed a scheme to overcome the limitations in the conversion of $CH_4$—$CH_3OH$ in a liquid phase reaction. An aqueous medium favorably solvates methanol and increase the methanol activation barrier. Also, various oxidizing agents (e.g., $H_2SO_4$, $H_2O_2$, $O_2$, etc.) can be applied. Previously, Hutchings reported a liquid phase $CH_4$—$CH_3OH$ conversion using a homogeneous catalyst, i.e., Fe- or Cu-promoted Fe-ZSM5, in the presence of an oxidizing agent $H_2O_2$. The oxidizing agent supplies oxygen through a radical mechanism to form methanol. In the study of Hutchings, methanol was produced at a conversion rate of 80 μmol/$g_{cat}$/hr with a selectivity of 92% at 50° C. Conversion to methanol through a similar reaction mechanism in the presence of various noble metal catalysts including AuPd, Ru and Pd was demonstrated. Even with a high selectivity, they are sensitive to reaction temperature and rapidly decrease in reactivity at mild temperature.

Recently, photocatalytic and electrochemical methane conversion provides a new possibility to a liquid phase reaction. Photocatalytic or electrocatalytic activation has achieved decoupled conversion at reaction temperature. Morante demonstrated photocatalytic $CH_4$—$CH_3OH$ conversion using a $WO_3$ catalyst. Hydroxyl radicals generated from the $WO_3$ catalyst through oxidation of water induce activation of methane. In the study of Morante, a conversion rate of 67.5 μmol/$g_{cat}$/hr was achieved at room temperature. Wang used a fenton reaction of $Fe^{2+}$ in photocatalytic activation. In the study of Wang, a conversion rate of 471 μmol/$g_{cat}$/hr and a $CH_3OH$ selectivity of 83% were achieved at room temperature. Sun reported that methanol was produced at a conversion rate of 25 μmol/$g_{cat}$/hr with a faradaic efficiency of 89% at room temperature by using a NiO/Ni catalyst. Surendranath achieved a conversion rate of 268 μmol/$g_{cat}$/hr and a selectivity of 69% by using a $Pt^{II}$: $Pt^{IV}$ catalyst. According to the above results, methane conversion at room temperature has great prospects. To economically perform the above process, continuous improvement in productivity is needed and influences on the environment need to be considered.

A variety of mixed transition metal oxide catalysts have been applied to electrochemical $CH_4$ oxidation, but a combination of catalysts CuO and $CeO_2$ have not been studied. Also, since it was confirmed that Cu is a key ingredient in a biocatalyst of methane monooxygenase (MMO) capable of single step $CH_4$—$CH_3OH$ conversion, Cu-based catalysts have been actively applied to $CH_4$ oxidation. Gas phase $CH_4$—$CH_3OH$ conversion with high productivity in various Cu-based catalysts including Cu-modified zeolite, CuO nanoclusters and a Cu-loaded MOF has been reported. Meanwhile, it was reported that the $CeO_2$ support improves activation of C—H bonds due to high-density oxygen pores and $Ce^{4+}$/$Ce^{3+}$ conversion. However, CuO/$CeO_2$ has not yet been investigated for electrochemical $CH_4$ conversion.

Prior Art Document

Patent Document 1: Korean Patent Laid-open Publication No. 10-2019-0036268

SUMMARY

In view of the foregoing, the present disclosure provides a porous nanoparticle catalyst for methane conversion, including a first metal oxide and a second metal oxide.

However, problems to be solved by the present disclosure are not limited to the above-described problems. Although not described herein, other problems to be solved by the present disclosure can be clearly understood by those skilled in the art from the following descriptions.

A first aspect of the present disclosure provides a porous nanoparticle catalyst for methane conversion, including a first metal oxide and a second metal oxide, wherein a first metal includes at least one selected from V, Sn, In, Au, Hg, Rb, Mn, Fe, Co, Ni, Cu, Zn and Mo, and wherein a second metal includes at least one selected from Y, La, Gd, Ga, Mg, Ca, Li, Ti, Zr, Ce, and Al.

A second aspect of the present disclosure provides a method of preparing the porous nanoparticle catalyst for methane conversion according to the first aspect, including dissolving a first metal precursor and a second metal precursor in an alcohol and performing a first heat treatment in the presence of a glycerin to obtain a metal mixture; and washing the metal mixture with an organic solvent and performing a second heat treatment for removing the glycerin to obtain the porous nanoparticle catalyst for methane conversion.

A third aspect of the present disclosure provides a catalyst electrode, including the porous nanoparticle catalyst for methane conversion according to the first aspect.

According to the embodiments of the present disclosure, a first metal, a second metal and oxygen are uniformly distributed inside a porous nanoparticle catalyst for methane conversion.

According to the embodiments of the present disclosure, the porous nanoparticle catalyst for methane conversion has a small size of from about 0.3 μm to about 1.5 μm. Since it has a small size in sub-micrometer, it is possible to obtain a large surface area.

According to the embodiments of the present disclosure, glycerin, which is a pore former, is distributed inside the porous nanoparticle catalyst for methane conversion during a heat treatment, and pores can be uniformly formed through anion exchange reaction between the glycerin and an oxide. The pores are formed at places where glycerin has been removed. Due to the above-described process, a catalyst film can be preserved between nanoparticles.

According to the embodiments of the present disclosure, a methane conversion reaction of the porous nanoparticle catalyst for methane conversion can be carried out at room temperature and/or atmospheric pressure.

According to the embodiments of the present disclosure, the methane conversion reaction of the porous nanoparticle catalyst for methane conversion can be carried out through a solar cell, which increases economic feasibility.

According to the embodiments of the present disclosure, if an electrode including the porous nanoparticle catalyst for methane conversion is used as a working electrode, a methane conversion reaction and hydrogen generation occur at the same time in the working electrode and a counter electrode, respectively. Thus, it is possible to produce energy resources at the same time.

According to the embodiments of the present disclosure, the porous nanoparticle catalyst for methane conversion can oxidize methane and generate hydrogen simultaneously at a low potential of about 1.23 V or less at which water decomposition occurs conventionally. Thus, it is possible to generate hydrogen using lower power than that required for the conventional water decomposition.

According to the embodiments of the present disclosure, the porous nanoparticle catalyst for methane conversion can be used as a high-efficiency electrochemical catalyst and thus is energy-efficient and eco-friendly.

BRIEF DESCRIPTION OF THE DRAWINGS

In the detailed description that follows, embodiments are described as illustrations only since various changes and modifications will become apparent to those skilled in the art from the following detailed description. The use of the same reference numbers in different figures indicates similar or identical items.

FIG. 5C(i) to 5C(iv) are EDS mapping images of the catalyst prepared with composition ratio of 4:6, according to an example of the present disclosure.

FIG. 6 shows an X-ray diffraction (XRD) analysis of the catalysts prepared with composition ratios of 8:2, 6:4, and 4:6, respectively, according to an example of the present disclosure.

DETAILED DESCRIPTION

Figure 1:
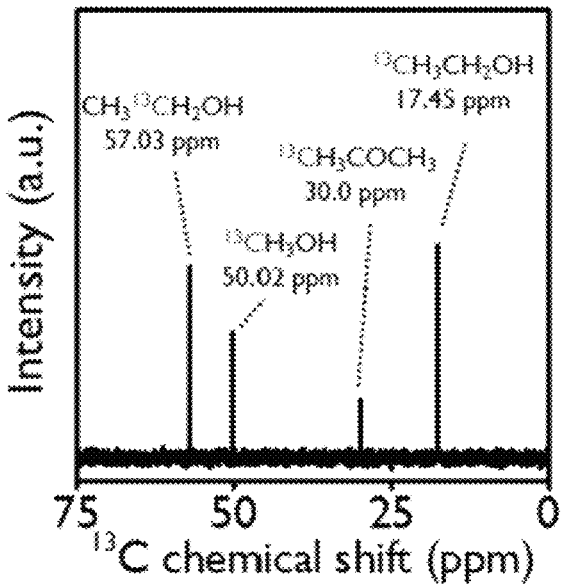
FIG. 1 is the $^{13}C$ NMR spectra of a catalyst prepared according to an example of the present disclosure.

Hereinafter, examples of the present disclosure will be described in detail with reference to the accompanying drawings so that the present disclosure may be readily implemented by those skilled in the art. However, it is to be noted that the present disclosure is not limited to the examples but can be embodied in various other ways. In drawings, parts irrelevant to the description are omitted for the simplicity of explanation, and like reference numerals denote like parts through the whole document.

Through the whole document, the term "connected to" or "coupled to" that is used to designate a connection or coupling of one element to another element includes both a case that an element is "directly connected or coupled to" another element and a case that an element is "electronically connected or coupled to" another element via still another element.

Through the whole document, the term "on" that is used to designate a position of one element with respect to another element includes both a case that the one element is adjacent to the other element and a case that any other element exists between these two elements.

Further, through the whole document, the term "comprises or includes" and/or "comprising or including" used in the document means that one or more other components, steps, operation and/or existence or addition of elements are not excluded in addition to the described components, steps, operation and/or elements unless context dictates otherwise.

Through the whole document, the term "about or approximately" or "substantially" is intended to have meanings close to numerical values or ranges specified with an allowable error and intended to prevent accurate or absolute numerical values disclosed for understanding of the present disclosure from being illegally or unfairly used by any unconscionable third party.

Through the whole document, the term "step of" does not mean "step for".

Through the whole document, the term "combination of" included in Markush type description means mixture or combination of one or more components, steps, operations and/or elements selected from a group consisting of components, steps, operation and/or elements described in Markush type and thereby means that the disclosure includes one or more components, steps, operations and/or elements selected from the Markush group.

Through this whole specification, a phrase in the form "A and/or B" means "A or B, or A and B".

Hereinafter, embodiments and examples of the present disclosure will be described in detail with reference to the accompanying drawings. However, the present disclosure may not be limited to the following embodiments, examples, and drawings.

A first aspect of the present disclosure provides a porous nanoparticle catalyst for methane conversion, including a first metal oxide and a second metal oxide, wherein a first metal includes at least one selected from V, Sn, In, Au, Hg, Rb, Mn, Fe, Co, Ni, Cu, Zn and Mo, and wherein a second metal includes at least one selected from Y, La, Gd, Ga, Mg, Ca, Li, Ti, Zr, Ce, and Al.

In an embodiment of the present disclosure, the first metal may be a component mainly serving as a catalyst in a porous nanoparticle catalyst for methane conversion, and the second metal may be a component serving as a pump that helps supply more oxygen.

In an embodiment of the present disclosure, a molar ratio of the first metal oxide: the second metal oxide may be about 8:2 to about 4:6, but may not be limited thereto. In an embodiment of the present disclosure, the molar ratio of the first metal oxide: the second metal oxide may be about 8:2, about 7:3, about 6:4, about 5:5, or about 4:6, but may not be limited thereto. Specifically, the most excellent characteristics can be seen when a molar ratio of the first metal oxide: the second metal oxide is about 6:4. Here, the molar ratio may be measured based on a precursor of the first metal oxide and a precursor of the second metal oxide. In an embodiment of the present disclosure, if the molar ratio of the first metal oxide: the second metal oxide is greater than 8:2 (i.e., the content ratio of the first metal oxide is greater than 8), the activity may decrease due to the too small amount of the second metal oxide, and if the molar ratio of the first metal oxide: the second metal oxide is smaller than 4:6 (i.e., the content ratio of the second metal oxide is greater than 6), the charge transfer resistance may increase due to the use of a large amount of the second metal oxide, which may result in a decrease in conversion rate.

In an embodiment of the present disclosure, the first metal, the second metal and an oxygen may be uniformly dispersed in the porous nanoparticle catalyst for methane conversion.

In an embodiment of the present disclosure, the porous nanoparticle for methane conversion may be implemented in various shapes. In an embodiment of the present disclosure, the porous nanoparticle for methane conversion may have a spherical shape.

In an embodiment of the present disclosure, the first metal may have a monoclinic crystal structure and the second metal may have a fluorite crystal structure, but may not be limited thereto.

In an embodiment of the present disclosure, a size of the porous nanoparticle catalyst for methane conversion based on a single particle diameter may be about 0.3 μm to about 1.5 μm, but may not be limited thereto. In an embodiment of the present disclosure, the size of the porous nanoparticle catalyst for methane conversion based on a single particle diameter may be about 0.3 μm to about 1.5 μm, about 0.3 μm to about 1.4 μm, about 0.3 μm to about 1.3 μm, about 0.3 μm to about 1.2 μm, or about 0.3 μm to about 1.1 μm, but may not be limited thereto. Specifically, the porous nanoparticle catalyst for methane conversion has a small size in sub-micrometer and thus can have a large surface area. Also, glycerin, which is a pore former, is distributed inside the particle during a heat treatment, and pores can be uniformly formed through anion exchange reaction between the glycerin and an oxide. The pores are formed at places where glycerin has been removed. Due to the above-described process, a catalyst film can be preserved between spherical shapes. However, if the catalyst has a large size, pores cannot be uniformly formed in the catalyst film.

In an embodiment of the present disclosure, a specific surface area of the porous nanoparticle catalyst for methane conversion may be about 30 $m^2/g$ to about 60 $m^2/g$, but may not be limited thereto. In an embodiment of the present disclosure, the specific surface area of the porous nanoparticle catalyst for methane conversion may be about 30 $m^2/g$ to about 60 $m^2/g$, about 30 $m^2/g$ to about 55 $m^2/g$, about 30 $m^2/g$ to about 50 $m^2/g$, about 32 $m^2/g$ to about 60 $m^2/g$, about 32 $m^2/g$ to about 55 $m^2/g$, or about 32 $m^2/g$ to about 50 $m^2/g$, but may not be limited thereto.

In an embodiment of the present disclosure, the porous nanoparticle catalyst for methane conversion may convert a methane to at least one of the products selected from methanol, ethanol, 1-propanol, 2-propanol, and acetone, but may not be limited thereto.

In an embodiment of the present disclosure, a selectivity of the methanol among the products may be about 65% or more. In an embodiment of the present disclosure, the selectivity of the methanol among the products may be about 65% or more, about 67% or more, about 70% or more, or about 75% or more.

In an embodiment of the present disclosure, a productivity of the methanol may be about 200 $\mu mol/g_{cat}/hr$ to about 2000 $\mu mol/g_{cat}/hr$, but may not be limited thereto. In an embodiment of the present disclosure, the productivity of the methanol may be about 200 $\mu mol/g_{cat}/hr$ to about 2000 $\mu mol/g_{cat}/hr$, about 200 $\mu mol/g_{cat}/hr$ to about 1980 $\mu mol/g_{cat}/hr$, about 200 $\mu mol/g_{cat}/hr$ to about 1960 $\mu mol/g_{cat}/hr$, about 200 $\mu mol/g_{cat}/hr$ to about 1940 $\mu mol/g_{cat}/hr$, about 200 $\mu mol/g_{cat}/hr$ to about 1920 $\mu mol/g_{cat}/hr$, or about 200 $\mu mol/g_{cat}/hr$ to about 1900 $\mu mol/g_{cat}/hr$, but may not be limited thereto.

In an embodiment of the present disclosure, the productivity of the methanol may vary depending on reaction time, pressure and potential.

In an embodiment of the present disclosure, the methane conversion may be carried out at room temperature, but may not be limited thereto. Herein, the room temperature may be about 15° C. to about 35° C., or about 20° C. to about 30° C., but may not be limited thereto.

In an embodiment of the present disclosure, the methane conversion may be carried out at a pressure of about 1 bar to about 15 bar, but may not be limited thereto. In an embodiment of the present disclosure, the methane conversion may be carried out at a pressure of about 1 bar to about 15 bar, about 1 bar to about 14 bar, about 1 bar to about 13 bar, about 1 bar to about 12 bar, about 1 bar to about 11 bar, or about 1 bar to about 10 bar, but may not be limited thereto.

In an embodiment of the present disclosure, the methane conversion may be carried out using a solar cell, but may not be limited thereto. In an embodiment of the present disclosure, the methane conversion may be powerlessly carried out with connection to the solar cell without any power supply device. Therefore, the methane conversion can be carried out even at a voltage level applied just under sunlight, and, thus, it is eco-friendly and economical.

In an embodiment of the present disclosure, methane is converted to an oxygenate product (e.g., methanol, ethanol, etc.) in the working electrode through a methane conversion reaction and hydrogen is generated in the counter electrode, and, thus, it can be used as an energy source capable of generating energy at the same time. Methane can be oxidized at a potential of 1.23 V or less at which water decomposition occurs conventionally and at the same time hydrogen can be generated.

In an embodiment of the present disclosure, the porous nanoparticle catalyst for methane conversion can oxidize methane and generate hydrogen simultaneously even at a potential of 1.23 V or less at which water decomposition occurs conventionally. Thus, it is possible to generate hydrogen using lower power than that required for the conventional water decomposition.

In an embodiment of the present disclosure, the porous nanoparticle catalyst for methane conversion can be used as a high-efficiency electrochemical catalyst and thus is energy-efficient and eco-friendly.

A second aspect of the present disclosure provides a method of preparing the porous nanoparticle catalyst for methane conversion according to the first aspect, including dissolving a first metal precursor and a second metal precursor in an alcohol and performing a first heat treatment in the presence of a glycerin to obtain a metal mixture; and washing the metal mixture with an organic solvent and performing a second heat treatment for removing the glycerin to obtain the porous nanoparticle catalyst for methane conversion.

Detailed descriptions on the second aspect of the present disclosure, which overlap with those on the first aspect of the present disclosure, are omitted hereinafter, but the descriptions of the first aspect of the present disclosure may be identically applied to the second aspect of the present disclosure, even though they are omitted hereinafter.

In an embodiment of the present disclosure, the alcohol may be methanol, ethanol, propanol, iso-propanol, butanol, iso-butanol, sec-butanol, hexanol, aldehyde carboxylic acid, ethylene glycol, or propylene glycol.

In an embodiment of the present disclosure, the glycerin may serve to form pores in the porous nanoparticle catalyst for methane conversion. Also, the glycerin may serve to form the porous nanoparticle for methane conversion into a spherical shape.

In an embodiment of the present disclosure, the first heat treatment may be performed at about 150° C. to about 200° C., but may not be limited thereto. In an embodiment of the present disclosure, the first heat treatment may be performed at about 150° C. to about 200° C., about 150° C. to about 190° C., about 150° C. to about 180° C., about 160° C. to about 200° C., about 160° C. to about 190° C., about 160° C. to about 180° C., about 170° C. to about 200° C., about 170° C. to about 190° C., or about 170° C. to about 180° C., but may not be limited thereto.

In an embodiment of the present disclosure, the first heat treatment may be performed for about 5 hours to about 10 hours, but may not be limited thereto. In an embodiment of the present disclosure, the first heat treatment may be performed for about 5 hours to about 10 hours, about 5 hours to about 10 hours, about 5 hours to about 9 hours, about 5 hours to about 8 hours, about 5 hours to about 7 hours, about 6 hours to about 10 hours, about 6 hours to about 9 hours, about 6 hours to about 8 hours, or about 6 hours to about 7 hours, but may not be limited thereto.

In an embodiment of the present disclosure, the organic solvent may include alcohols such as methanol, ethanol, n-propanol, iso-propanol, n-butanol, iso-butanol, or tert-butanol, but may not be limited thereto. In an embodiment of the present disclosure, the organic solvent may be ethanol. Herein, the organic solvent may be identical to or different from the alcohol.

In an embodiment of the present disclosure, the second heat treatment may be performed at about 300° C. to about 400° C., but may not be limited thereto. In an embodiment of the present disclosure, the second heat treatment may be performed at about 300° C. to about 400° C., about 300° C. to about 390° C., about 300° C. to about 380° C., about 300° C. to about 370° C., about 300° C. to about 360° C., about 320° C. to about 400° C., about 320° C. to about 390° C., about 320° C. to about 380° C., about 320° C. to about 370° C., or about 320° C. to about 360° C., but may not be limited thereto.

In an embodiment of the present disclosure, the second heat treatment may be performed for about 1 hour to about 5 hours, but may not be limited thereto. In an embodiment of the present disclosure, the second heat treatment may be performed for about 1 hour to about 5 hours, about 1 hour to about 4 hours, about 1 hour to about 3 hours, about 1 hour to about 2 hours, about 2 hours to about 5 hours, about 2 hours to about 4 hours, or about 2 hours to about 3 hours, but may not be limited thereto.

A third aspect of the present disclosure provides a catalyst electrode, including the porous nanoparticle catalyst for methane conversion according to the first aspect.

Detailed descriptions on the third aspect of the present disclosure, which overlap with those on the first aspect and the second aspect of the present disclosure, are omitted hereinafter, but the descriptions of the first aspect and the second aspect of the present disclosure may be identically applied to the third aspect of the present disclosure, even though they are omitted hereinafter.

In an embodiment of the present disclosure, the catalytic electrode may be included in a fuel cell, a biofuel cell, a solar cell, a secondary cell and a super capacitor, but may not be limited thereto.

In an embodiment of the present disclosure, the fuel cell may be a direct methanol fuel cell (DMFC), but may not be limited thereto. Specifically, the fuel cell uses the same components as a polymer electrolyte membrane fuel cell (PEMFC), but can be directly used as a fuel without a need to convert methanol to hydrogen. Therefore, the fuel cell can be miniaturized.

Hereinafter, example embodiments are described in more detail by using Examples, but the present disclosure may not limited to the Examples.

EXAMPLES

Example. Preparation of Porous Copper Oxide-Cerium(IV) Oxide Nanoparticle Catalyst To prepare a porous copper oxide-cerium(IV) oxide ($CuO/CeO_2$) nanoparticle catalyst, 1.5 mM copper(II) nitrate trihydrate [$Cu(NO_3)_2.3H_2O$] (98% to 103%, Aldrich) as a copper precursor and 1.0 mM cerium(III) nitrate hexahydrate [$Ce(NO_3)_3.6H_2O$] (99%, Aldrich) as a cerium precursor were used. The precursors were mixed at various molar ratios (Cu:Ce=8:2, 6:4, or 4:6) and dissolved in isopropyl alcohol. Then, 2.3 M glycerin, which is a pore former, was added into the solution and strongly stirred for 30 minutes. The solution, which became transparent, was transferred to a Teflon lined stainless steel autoclave reactor and then was subjected to a first heat treatment at a temperature of 180° C. and kept for 6 hours. After the temperature of the autoclave reactor was lowered to room temperature, a precipitate was separated through centrifugation. The separated precipitate was washed with ethanol several times and then dried at 80° C. for 12 hours. CuCe-glycerate obtained after drying was subjected to a second heat treatment at 350° C. and heated for 2 hours to remove glycerin. As a result, a porous spherical copper oxide-cerium(IV) oxide ($CuO/CeO_2$) nanoparticle catalyst was prepared.

Comparative Example. Preparation of Copper Oxide-Cerium(IV) Oxide Nanoparticle Catalyst To prepare a copper oxide-cerium(IV) oxide ($CuO/CeO_2$) nanoparticle catalyst, 1.5 mM copper(II) nitrate trihydrate (98% to 103%, Aldrich) as a copper precursor and 1.0 mM cerium(III) nitrate hexahydrate (99%, Aldrich) as a cerium precursor were used. Each of the precursors was dissolved in distilled water at various molar ratios (Cu:Ce=8:2, 6:4, or 4:6) and then stirred for 1 hour at room temperature. The two stirred solutions were mixed through coprecipitation and then stirred for 30 minutes or more at room temperature. After the mixed solution was dried at 100° C. for 6 hours or more, dried powder was heated at 350° C. for 2 hours. As a result, a copper oxide-cerium(IV) oxide ($CuO/CeO_2$) nanoparticle catalyst was prepared.

Analysis of Characteristics of Porous Copper Oxide-Cerium (IV) Oxide Nanoparticle Catalyst 1) Measurement of Nuclear Magnetic Resonance (NMR)

The $^{13}C$ NMR of the porous $CuO/CeO_2$ nanoparticle catalyst (Example) obtained according to the example was measured. Referring to the NMR spectra in FIG. 1, it can be seen that $^{13}C$ is contained in all of oxygenate products including methanol (50.02 ppm). The presence of ethanol and acetone ($CH_3COCH_3$) can be seen from the presence of methane.

2) Measurement of Gas Chromatography (GC)

GC was obtained by gas chromatography (7820A, Agilent Technologies, USA) using a flame ionization detector (FID). As for the GC, a PoraPLOT Q column was used and a sample was injected using a gas-tight syringe at a temperature of 250° C. The FID was used at fuel flow rates of 300 mL/min of Ar and 40 mL/min of $H_2$ and an additional flow rate of 25 mL/min of $N_2$. The oven temperature conditions were 40° C., 80° C. (at 20° C./min) and 230° C. (at 30° C./min) for 2 minutes. Gas chromatography-mass spectra were recorded by gas chromatography (GC-MS, 7890B-5977A, Agilent Technologies, USA) equipped with a mass selective detector (MSD 5975) (electron impact ionization (EI), 70 eV, Agilent Technologies). A fused-silica capillary column (DB-WAX, coated with poly(ethylene glycol) to a thickness of 0.5 μm, Agilent Technologies, USA) was used. The samples were injected by headspace sampling (1000 ul of the samples heated at from 75° C. to 80° C. for 45 minutes) at a temperature of 250° C. The carrier gas was helium (1 mL/min, 99.999%), and the dilution ratio was 10:1 (sample:He). The oven temperature conditions were 40° C.

for 5 minutes, 4° C./minute (100° C.), and 240° C. for 3 minutes (20° C./minute). The $^{13}$C-NMR was recorded using an Avance III HD 400 FT-NMR spectrometer (Bruker Biospin). The measurement was corrected using residual signals of 3-(trimethylsilyl)-1-propane sulfonic acid sodium salt (DSS) at δ=0.0 ppm. For analysis, about 0.4 mL of a product was injected into an NMR tube. The proton high power decoupling field strength was 11.7 G (5.0 μs length of 90° $^{1}$H pulse). The contact time was 4 ms at Hartmann-Hahn matching condition of 50 kH, and the delay time between scans was 3 seconds. $^{13}$C chemical shifts of the product were analyzed with accuracy of ±0.5 ppm. Tetramethylsilane (TMS) was used as the external reference.

3) Scanning Electron Microscopy (SEM) Analysis

SEM was recorded using a JSM-7800F (JEOL). To analyze SEM images of the porous $CuO/CeO_2$ nanoparticle catalyst (Example) and the $CuO/CeO_2$ nanoparticle catalyst (Comparative Example), an electron microscope (JEOL, Japan) was used.

Figure 2A:
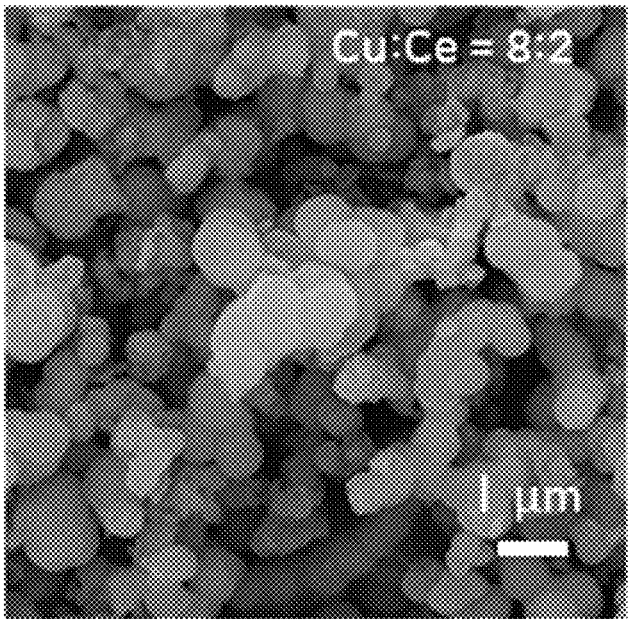
FIG. 2A to FIG. 2C are scanning electron microscope (SEM) images of catalysts prepared with composition ratios of 8:2, 6:4, and 4:6, respectively, according to an example of the present disclosure.
Figure 2B:
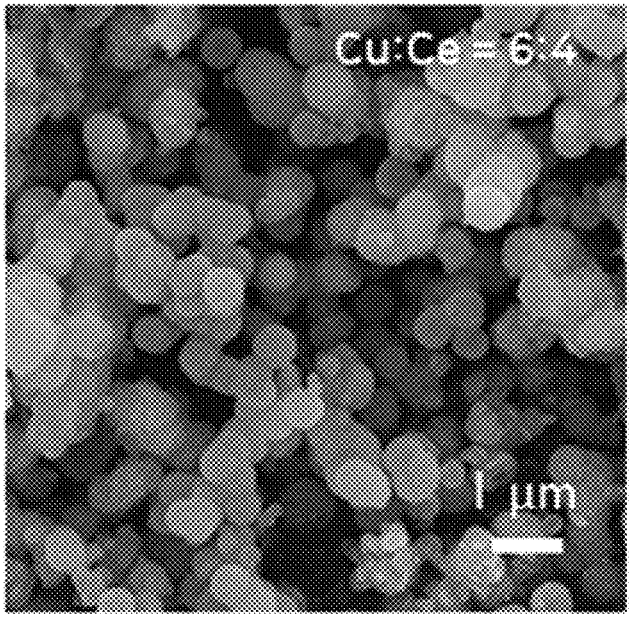
Figure 2C:
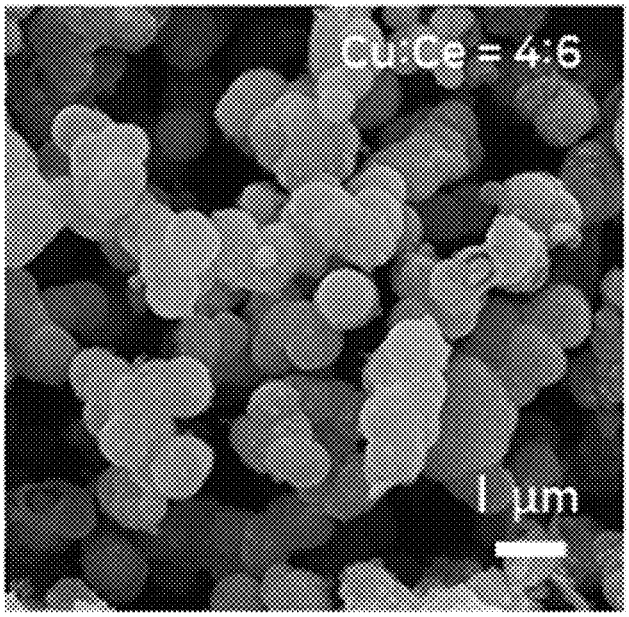

After the amount of glycerin used as a pore former in preparing the porous $CuO/CeO_2$ nanoparticle catalyst (Example) was controlled as a fixed variable, a copper precursor and a cerium precursor were mixed at various molar ratios (8:2, 6:4, or 4:6) to synthesize particles through hydrothermal synthesis. After the porous $CuO/CeO_2$ nanoparticle catalyst (Example) was attached onto a carbon tape and coated with gold, SEM images (10,000×) were obtained. The particle shape for each ratio can be seen from the SEM analysis shown in FIGS. 2A, 2B, and 2C. As can be seen from the SEM images in FIGS. 2 A, 2B, and 2C, a spherical particle of the porous $CuO/CeO_2$ nanoparticle catalyst (Example) has a size of from about 0.3 μm to about 1.1 μm and the catalyst was synthesized into similar shapes and similar sizes at various molar ratios (8:2, 6:4, or 4:6).

Figure 3A:
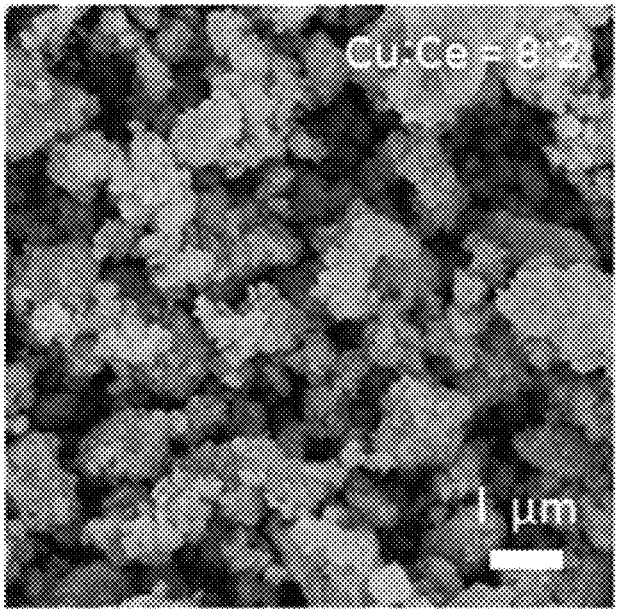
FIG. 3A to FIG. 3C are SEM images of catalysts prepared with composition ratios of 8:2, 6:4, and 4:6, respectively, according to a comparative example of the present disclosure.
Figure 3B:
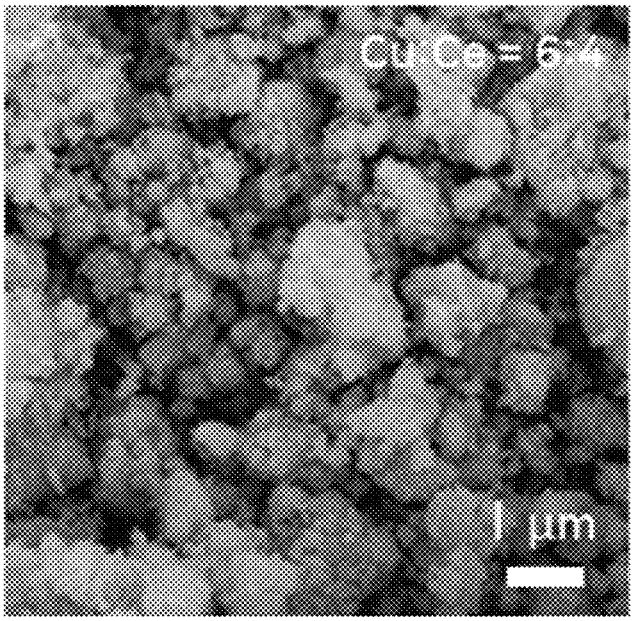
Figure 3C:
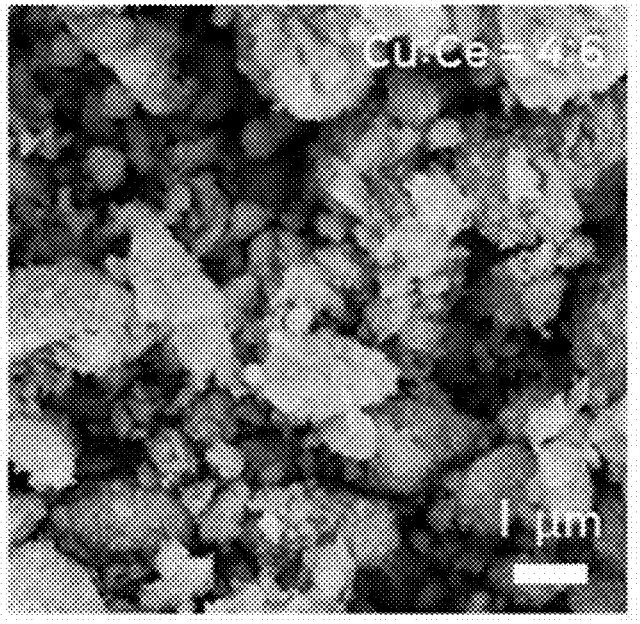

As for the $CuO/CeO_2$ nanoparticle catalyst (Comparative Example), a copper precursor and a cerium precursor were mixed at various molar ratios (8:2, 6:4, or 4:6) to synthesize particles through coprecipitation. The measurement was carried out in the same manner as describe above and can be seen from the SEM analysis shown in FIGS. 3A, 3B, and 3C. As can be seen from the SEM images in FIGS. 3A, 3B, and 3C, a spherical particle of the $CuO/CeO_2$ nanoparticle catalyst (Comparative Example) has a size of from about 3 μm to about 5 μm and the catalyst was synthesized into similar shapes and similar sizes at various molar ratios (8:2, 6:4, or 4:6), but was not formed into a porous spherical shape.

4) Transmission Electron Microscopy (TEM) Analysis

Figure 4A:
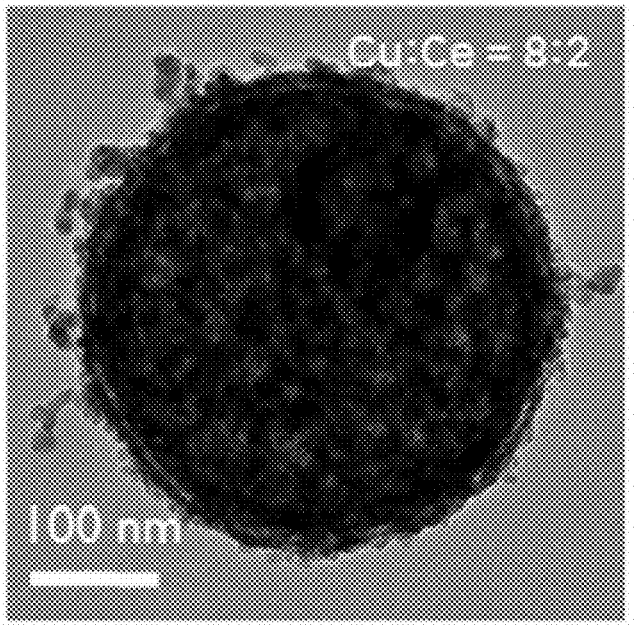
FIG. 4A to FIG. 4C are transmission electron microscopy (TEM) images of the catalysts prepared with composition ratios of 8:2, 6:4, and 4:6, respectively, according to an example of the present disclosure.
Figure 4B:
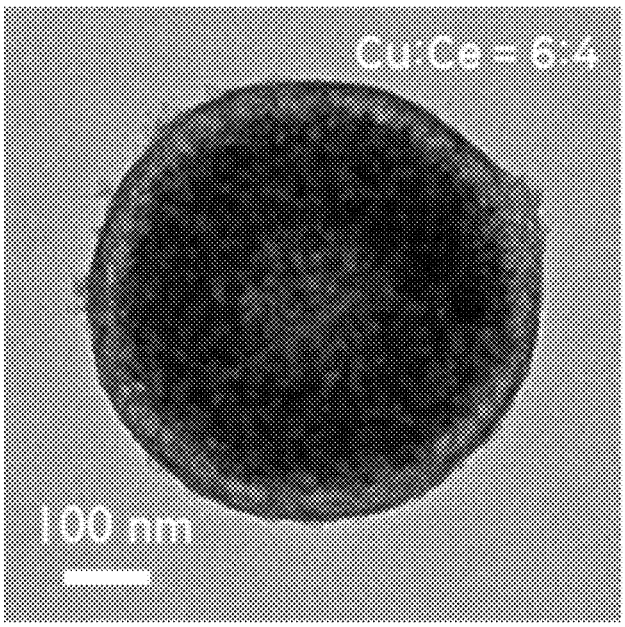
Figure 4C:
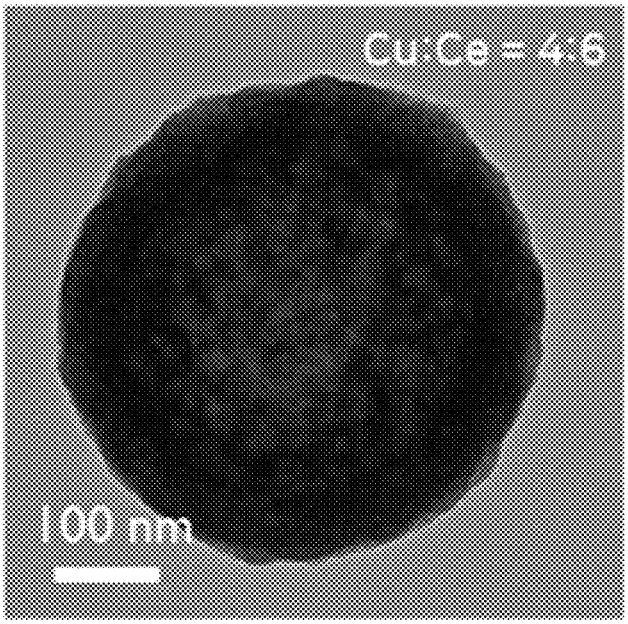

TEM was recorded using a JEM-4300 (JEOL). 5 mg of the porous $CuO/CeO_2$ nanoparticle catalyst (Example) was dispersed in 1 mL of a water solvent by ultrasonication for about 5 minutes and then loaded on a grid for TEM analysis. The morphology of the synthesized porous $CuO/CeO_2$ nanoparticle catalyst (Example) was analyzed from the TEM images in FIGS. 4A, 4B, and 4C. As can be seen from FIGS. 4A, 4B, and 4C, a porous spherical nanoparticle having a diameter of about 500 nm is seen from a catalyst at each ratio, and a porous portion can be observed inside the particle.

5) Energy Dispersive Spectroscopy (EDS) Mapping Analysis

TEM images were taken, and EDS mapping analysis of copper oxide, cerium(IV) and oxygen was conducted through EDS (which is a method to spectroscopically analyze the energy and amount of the X-ray coming from the sample after interaction between the incident electron and the sample) analysis on the corresponding regions.

Figure 5A:
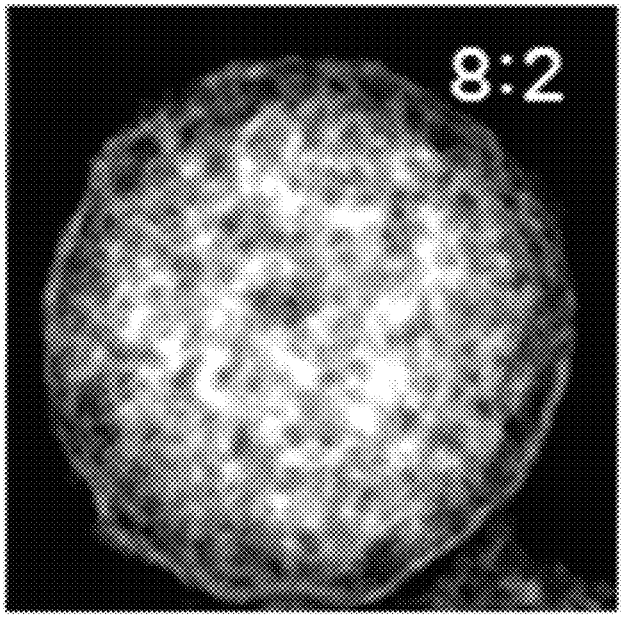
FIG. 5A(i) to FIG. 5A(iv) are energy dispersive spectroscopy (EDS) mapping images of the catalyst prepared with composition ratio of 8:2, according to an example of the present disclosure.
Figure 5A:
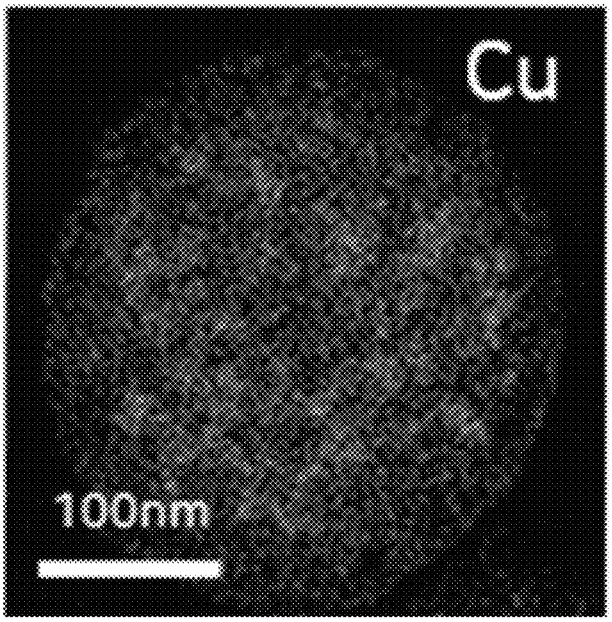
Figure 5B:
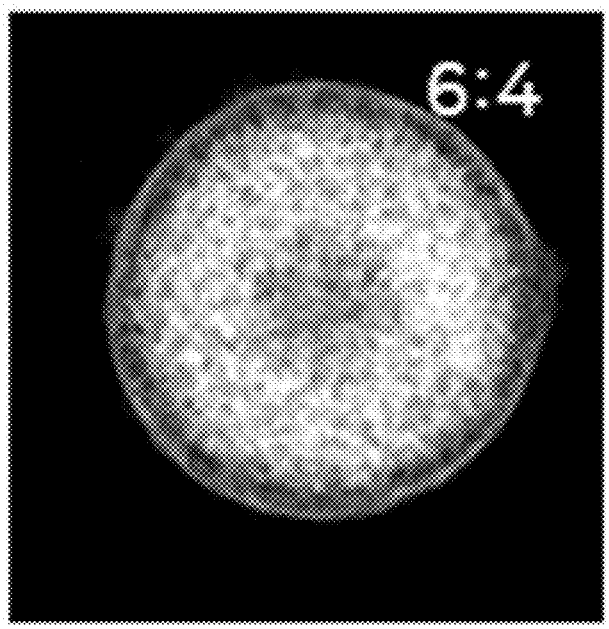
FIG. 5B(i) to FIG. 5A(iv) are EDS mapping images of the catalyst prepared with composition ratio of 6:4, according to an example of the present disclosure.

It can be seen from FIGS. 5A(i), 5A(ii), 5A(iii), 5A(iv), 5B(i), 5B(ii), 5B(iii), 5B(iv), 5C(i), 5C(ii), 5C(iii), and 5C(iv), that the elemental ratios of the porous $CuO/CeO_2$ nanoparticle catalyst (Example) vary depending on various molar ratios (Cu:Ce=8:2, 6:4, or 4:6). Copper, cerium and oxygen are shown as blue-green dots, purple dots and light green dots, respectively, and copper, cerium and oxygen are uniformly distributed in a porous spherical nanoparticle of a catalyst at each ratio.

6) X-Ray Diffraction (XRD) Analysis

XRD was obtained in a 2 theta range of from 25° C. to 65° C. using a Rigaku miniflex-2005G303 X-ray diffractometer (Cu Kα radiation at 20 kV and 10 mA). The porous $CuO/CeO_2$ nanoparticle catalyst (Example) was coated on a grid and an X-ray beam was irradiated thereto while changing the beam angle at 2 theta/min to measure the diffraction of the beam. Then, the crystallinity of the particle was analyzed.

In FIG. 6, monoclinic copper oxide (CuO) shows peaks at 32.5°(110), 35.5°($\bar{1}$11), 38.7°(111), 53.4°(020), 58.2°(202) and 61.5°(113), and cubic fluorite cerium oxide ($CeO_2$) shows peaks at 28.5°(111), 33.2°(200), 47.5°(220) and 56.3°(311). The porous $CuO/CeO_2$ nanoparticle catalyst (Example) with a molar ratio of 8:2 shows high peaks corresponding to CuO(110) and CuO($\bar{1}$11), and it can be seen that as the ratio of CuO decreases, the peaks corresponding to the crystal planes are lowered. Also, the crystalline size of $CuO/CeO_2$ with a molar ratio of 6:4 (Cu:Ce) was calculated using the Scherrer equation, and the crystalline size of CuO($\bar{1}$11) was 8.09 nm and the crystalline size of $CeO_2$(111) was 8.95 nm.

7) X-Ray Photoelectron Spectroscopy(XPS) Analysis

XPS was recorded by Leybold photoelectron spectroscopy (Al Ka monochromatic beam). To check the oxidation state of elements on the porous $CuO/CeO_2$ nanoparticle catalyst (Example), an X-ray photoelectron spectroscope was used. The outermost layer (several nm) of the catalyst was analyzed by XPS at high resolution. The XPS analysis shows that a large amount of surface oxygen was contained in $CuO/CeO_2$ and activation of $CH_4$ occurred on the surface of the catalyst due to active oxygen.

Figure 7A:
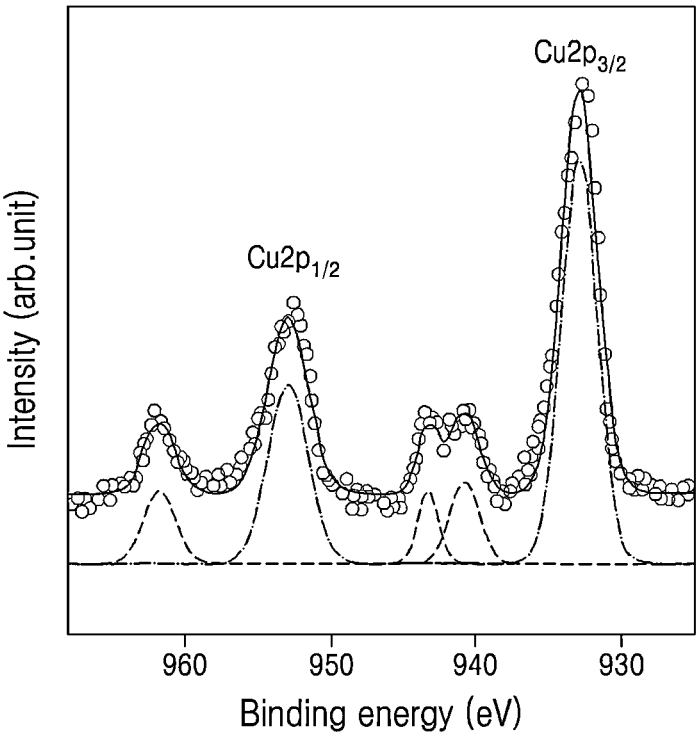
FIG. 7A shows an X-ray photoelectron spectroscopy (XPS) analysis of catalysts prepared according to an example of the present disclosure at Cu $2p_{3/2}$.
Figure 7B:
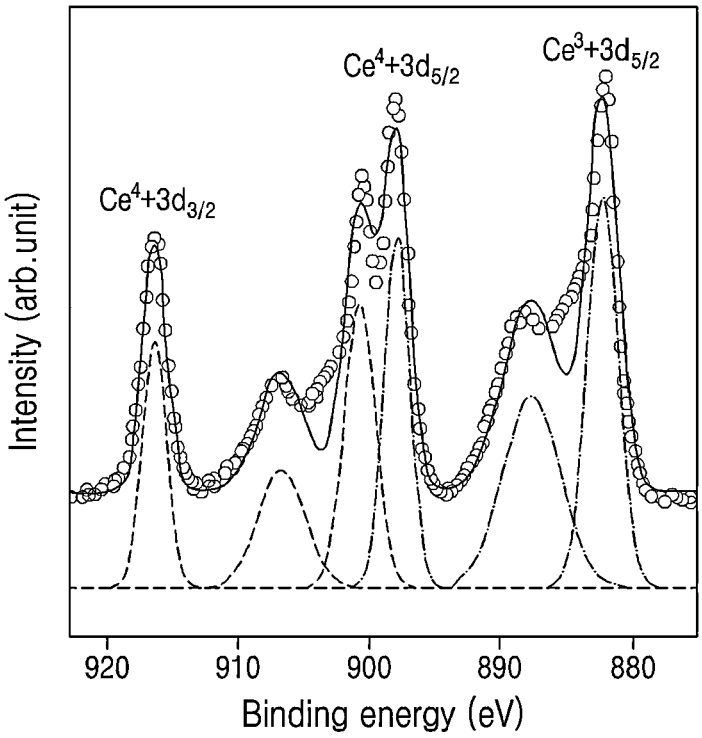
FIG. 7B shows an XPS analysis of the catalysts prepared according to an example of the present disclosure at Ce 3d.

The XPS analysis of $CuO/CeO_2$ is shown in FIGS. 7A and 7B. Referring to FIG. 7A, a Cu $2p_{3/2}$ main peak is situated at a binding energy of from 932.5 eV to 933.5 eV. A $Cu^{2+}$ main peak is situated at 933.5 eV and a $Cu^{+}$ main peak is situated at 932.5 eV due to the presence of $Ce^{3+}$ that promotes the redox equilibrium $Ce^{3+}+Cu^{2+} \rightleftharpoons Ce^{4+}+Cu^{+}$. The redox equilibrium between $Cu^{2+}$ and $Cu^{+}$ indicates a strong interaction between Cu and $CeO_2$. Also, referring to FIG. 7B, as a result of the XPS analysis of Ce 3d, a $Ce^{4}+3d_{3/2}$ main peak corresponding to 917.2 eV and a $Ce^{4}+3d_{5/2}$ main peak corresponding to 898 eV can be seen. The analysis of Ce 3d shows that cerium is present in an oxidation state of $Ce^{4+}$ on the surface of the porous $CuO/CeO_2$ nanoparticle catalyst (Example).

8) Brunauer-Emmett-Teller (BET) Analysis

Figure 8A:
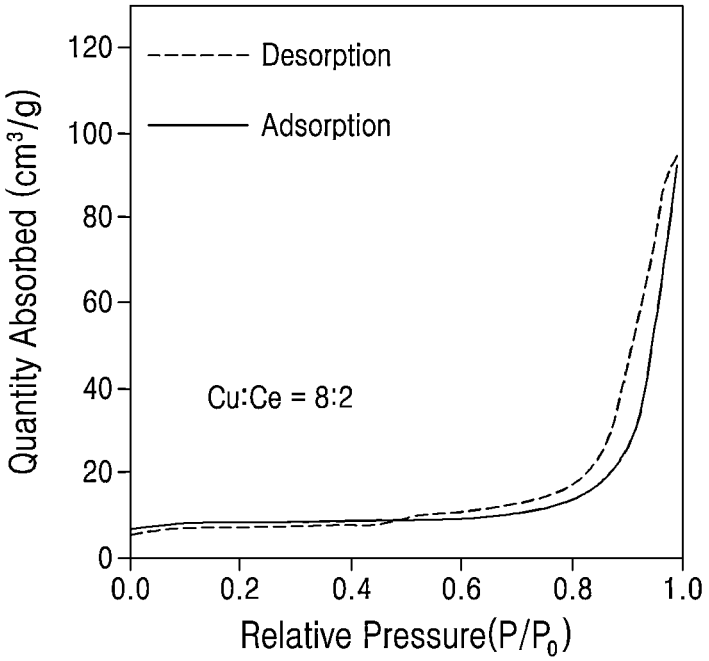
FIG. 8A to FIG. 8C are Brunauer-Emmett-Teller (BET) analysis of the catalysts prepared with composition ratios of 8:2, 6:4, and 4:6, respectively, according to an example of the present disclosure.
Figure 8B:
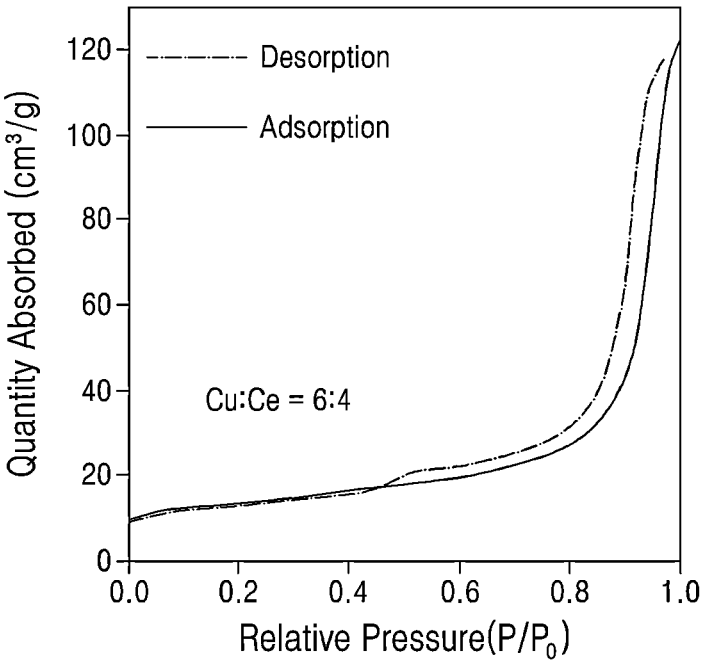
Figure 8C:
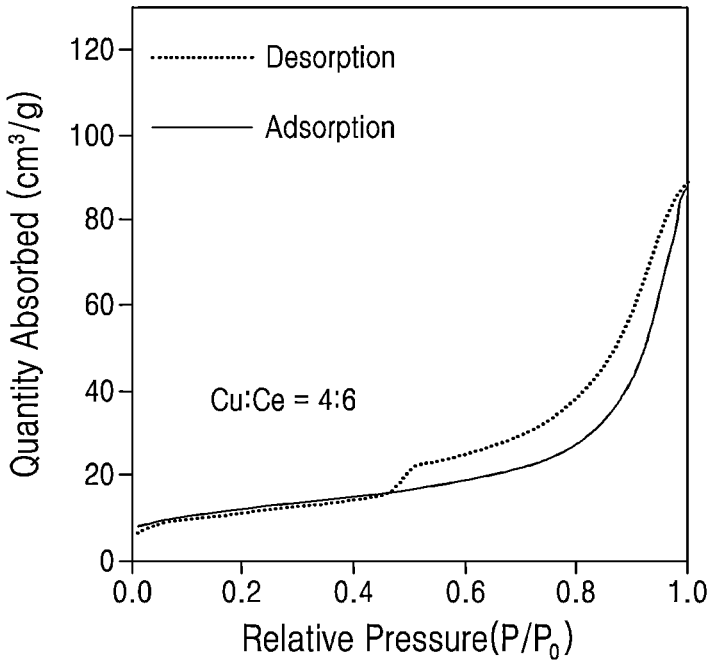

To check specific surface areas depending on various molar ratios of the porous $CuO/CeO_2$ nanoparticle catalyst (Example), Brunauer-Emmett-Teller (BET) analysis was conducted. FIGS. 8A, 8B, and 8C show the volume of nitrogen gas adsorbed at a given pressure, and the total volume of nitrogen adsorbed can be calculated by integrating all the adsorbed volumes and then converted into the surface area. Referring to FIGS. 8A, 8B, and 8C, the catalyst has specific surface areas of 32 $m^2/g$ and 36 $m^2/g$ at Cu/Ce molar ratios of 8:2 and 4:6, respectively, and has the greatest specific surface area at a Cu/Ce molar ratio of 6:4.

Test Example 1. Cyclic Voltammetry (CV) Electrochemical Analysis

1) CV of Porous $CuO/CeO_2$ Nanoparticle Catalyst (Example)

The methane conversion performance of the porous $CuO/CeO_2$ nanoparticle catalyst (Example) synthesized at various molar ratios (8:2, 6:4, or 4:6) was analyzed by cyclic voltammetry (CV) using a three-electrode electrochemical cell including a glassy carbon electrode loaded with the catalyst, a saturated calomel electrode (SCE) and a Pt plate. Herein, 0.5 M $Na_2CO_3$ was used as an electrolyte and the electrolyte was saturated with methane. This was obtained by bubbling methanol at a flow rate of 30 mL/min for 30 minutes in the solution. The catalytic electrode was obtained by coating the glassy carbon electrode with a solution (5 wt % $C_2H_5OH$ solution) in which catalyst particles are dispersed. CV was recorded using a potential difference (Versastat, Ametek). The scanning rate was 0.02 V/s, and EIS was recorded using an impedance analyzer (Versastat, AMETEK). The frequency range was from 1 MHz to 0.1 Hz, and the voltage amplitude was 10 mV.

Each of methane and an inactive gas was saturated with 0.5 M $Na_2CO_3$ solution and then, an three-electrode electrochemical evaluation was conducted in a 15 mL vial. After 12 μg of the catalyst was loaded on the glassy carbon electrode, the catalyst-coated electrode was used as a working electrode and the SCE electrode was used as a reference electrode and Pt was used as a counter electrode. The evaluation was conducted in a gas-tight reactor immersed in an aqueous solution containing $CO_3^{2-}$. CV analysis of the catalysts synthesized with various molar ratios at from 0.2 V to 1.0 V under methane saturation conditions was conducted.

Figure 9A:
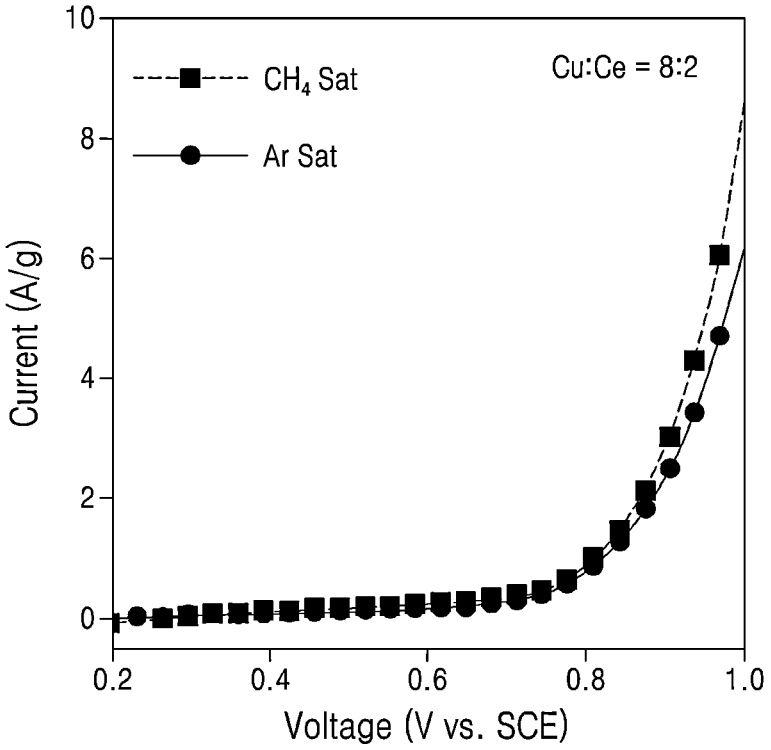
FIG. 9A to FIG. 9C are oxidation current analysis results of the catalysts prepared with composition ratios of 8:2, 6:4, and 4:6, respectively, according to an example of the present disclosure at 1.0 V vs. SCE.
Figure 9B:
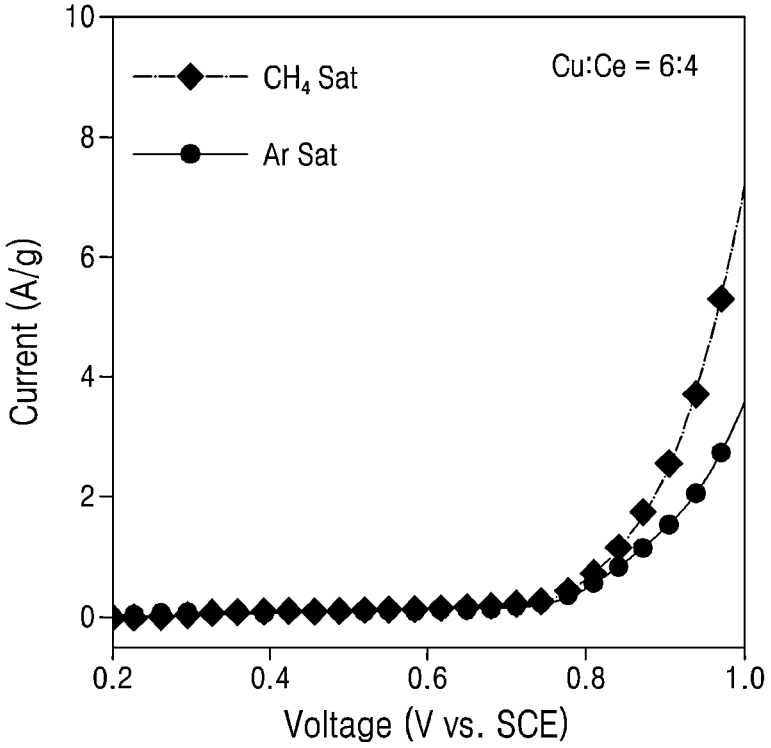
Figure 9C:
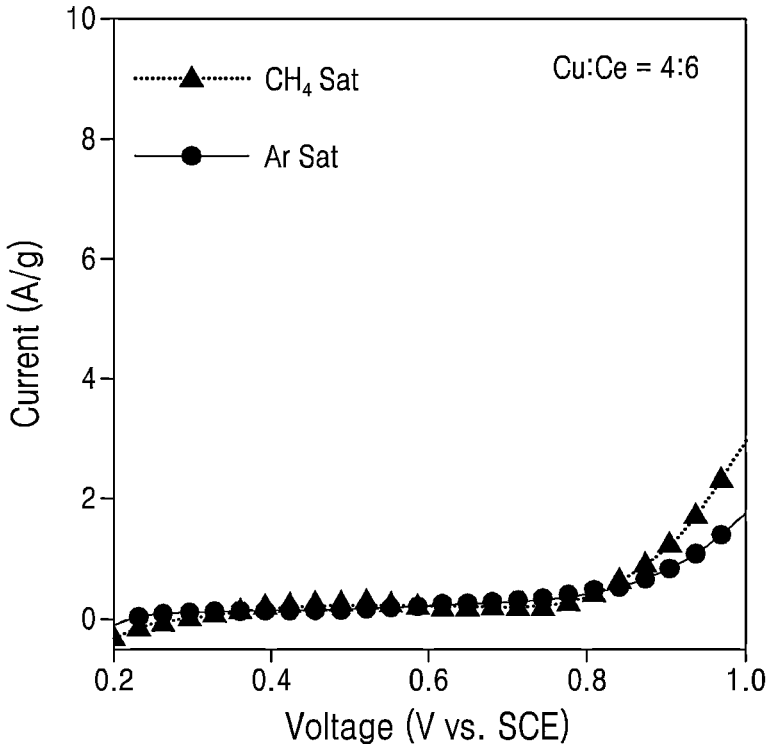

To check the methane oxidation, an oxidation current in a positive direction in which a voltage increases was checked. Referring to FIGS. 9A, 9B, and 9C, as a result of analysis of oxidation current at 1.0 V vs. SCE, 6:4 $CuO/CeO_2$ has a current density of 7.15 A/g under electrolyte methane saturation conditions and a current density of 3.5 A/g under electrolyte nitrogen saturation conditions (Ar sat). It can be seen that the current density is higher about twice under methane saturation conditions than under nitrogen saturation conditions, which means the occurrence of methane oxidation. Also, it can be seen that in the 8:2 $CuO/CeO_2$ nanoparticle catalyst and the $CuO/CeO_2$ nanoparticle catalyst with a Cu:Ce molar ratio of 4:6, the current density is higher under methane saturation conditions than under nitrogen saturation conditions.

Figure 10A:
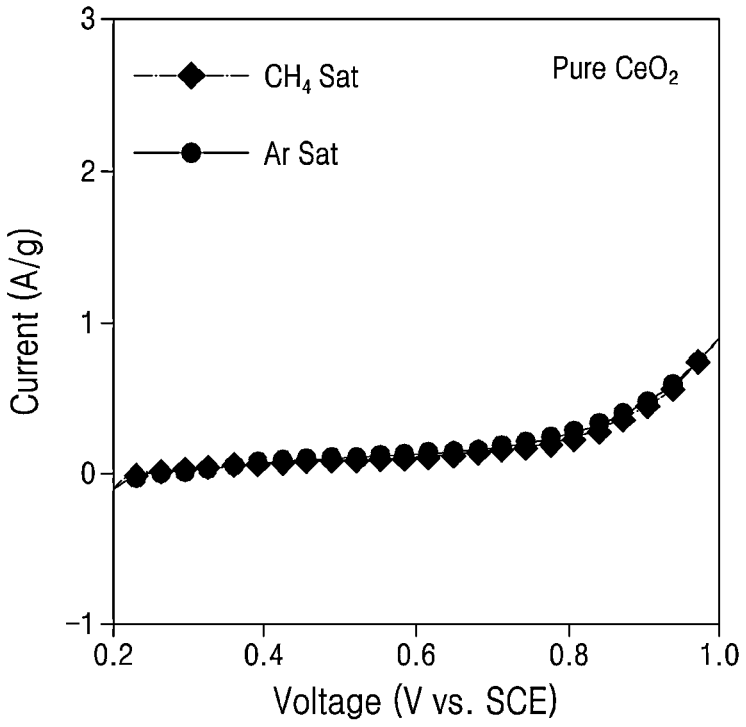
FIG. 10A shows a cyclic voltammetry (CV) plot for pure $CeO_2$.
Figure 10B:
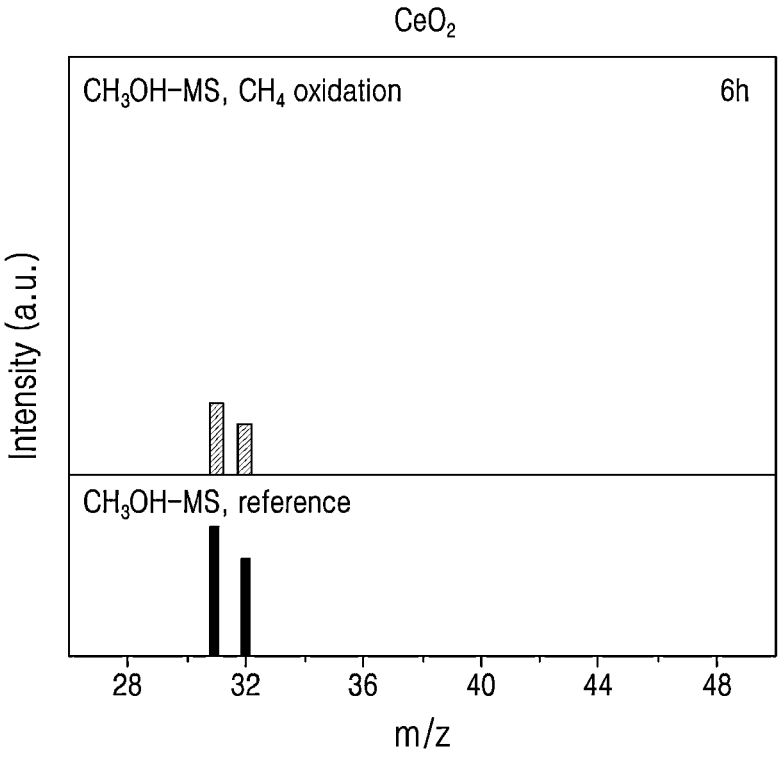
FIG. 10B show a GC-MS analysis of methanol after reaction with pure $CeO_2$.
Figure 10C:
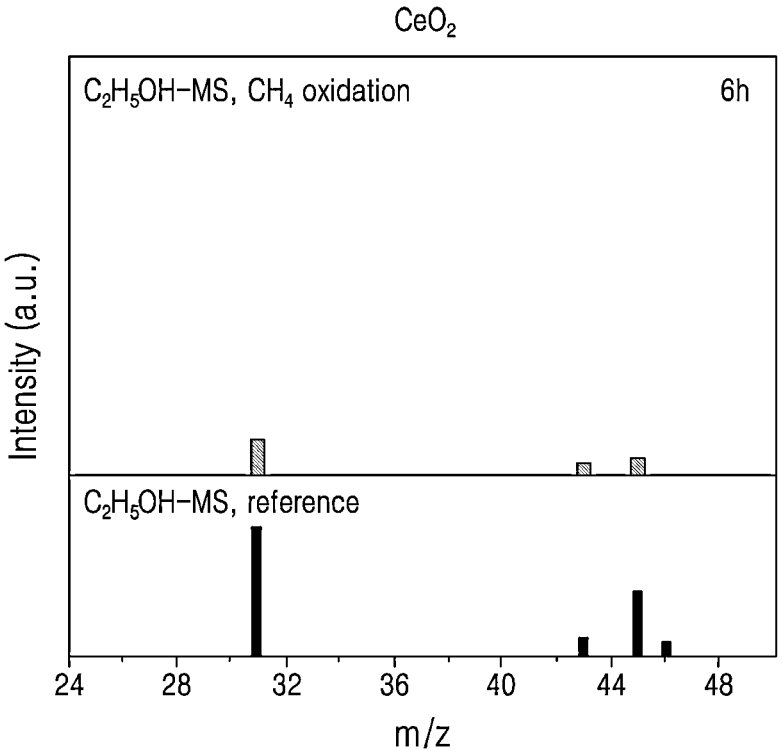
FIG. 10C show a GC-MS analysis of ethanol after reaction with pure $CeO_2$.
Figure 11A:
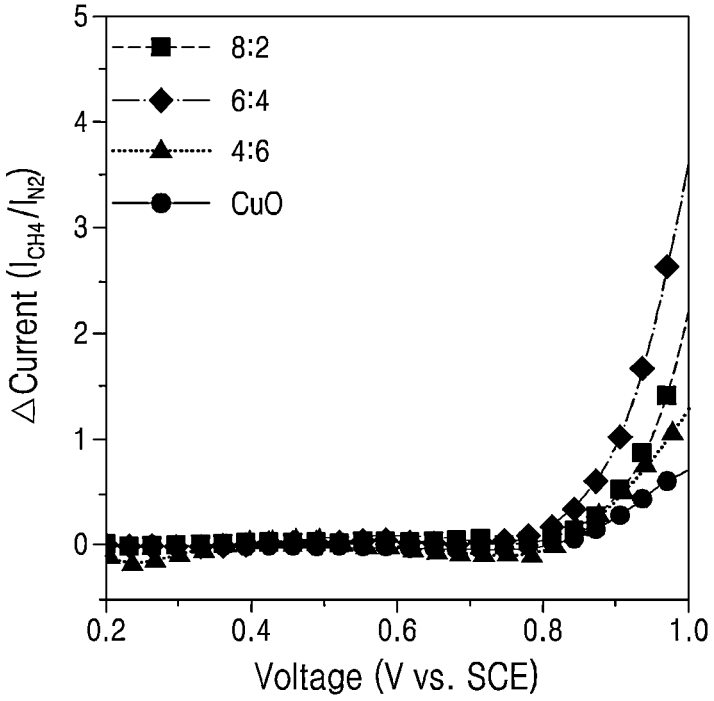
FIG. 11A shows oxidation currents observed through an anodic scan of CV curves of a porous spherical $CuO/CeO_2$ nanoparticle catalyst with various molar ratios (8:2, 6:4, or 4:6) (Example).
Figure 11B:
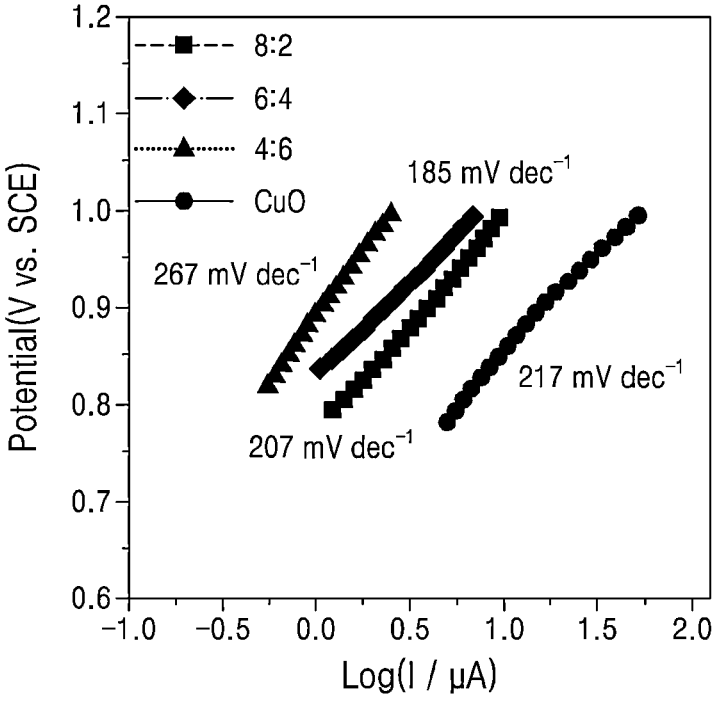
FIG. 11B shows catalytic dynamics observed through an anodic scan of CV curves of the porous spherical $CuO/CeO_2$ nanoparticle catalyst with various molar ratios (8:2, 6:4, or 4:6) (Example).

FIG. 10A shows the current density of pure $CeO_2$ under electrolyte methane saturation conditions ($CH_4$ sat) and electrolyte nitrogen saturation conditions (Ar sat), and FIG. 10B and FIG. 10C show a GC-MS analysis of methanol and ethanol after reaction with pure $CeO_2$. Referring to FIG. 10B, it can be seen that methanol was detected at 31 m/z and 32 m/z, and referring to FIG. 10C, it can be seen that ethanol was detected at 31 m/z, 43 m/z, 45 m/z and 46 m/z. It can be seen that the produced methanol and ethanol have low peaks due to low activity of pure $CeO_2$ to a methane conversion reaction, which means that methanol and ethanol are rarely detected in the reaction. The catalytic activity of CuO is improved by $CeO_2$, and when the amount of $CeO_2$ is too small, the activity decreases. A high production of the 6:4 $CuO/CeO_2$ catalyst is identical to the result of the comparison between the CV oxidation current and the Tafel slope. FIG. 11A shows an anodic scan of CV curves of the porous $CuO/CeO_2$ nanoparticle catalyst with various molar ratios (8:2, 6:4, or 4:6) (Example). The curves were corrected in an $N_2$-saturated solution with reference to CV curves, and shows an oxidation current that remarkably increases compared to a potential of about 0.8 V vs. SCE ($V_{SCE}$). Referring to FIG. 11A, it can be seen that the porous $CuO/CeO_2$ nanoparticle catalyst with various molar ratios (8:2, 6:4, or 4:6) (Example) shows a remarkably higher oxidation current than CuO (Comparative Example). In particular, the highest oxidation current can be observed in the porous $CuO/CeO_2$ nanoparticle catalyst with a Cu:Ce molar ratio of 6:4. In FIG. 11B, the porous $CuO/CeO_2$ nanoparticle catalyst with a Cu:Ce molar ratio of 6:4 shows the smallest slope of 185 mV/sec which means the highest catalytic dynamics. A catalyst having a greater or smaller amount of Cu than the porous $CuO/CeO_2$ nanoparticle catalyst with a Cu:Ce molar ratio of 6:4 shows an increase in the slope. That is, dynamic degradation can be observed. The slope of Tafel plot provides dynamic information of catalytic performance.

2) CV of $CuO/CeO_2$ Nanoparticle Catalyst (Comparative Example)

The methane conversion performance of the $CuO/CeO_2$ nanoparticle catalyst (Comparative Example) synthesized at various molar ratios (8:2, 6:4, or 4:6) through coprecipitation was analyzed by cyclic voltammetry (CV) in the same manner as in Test Example 1-1.

Figure 12A:
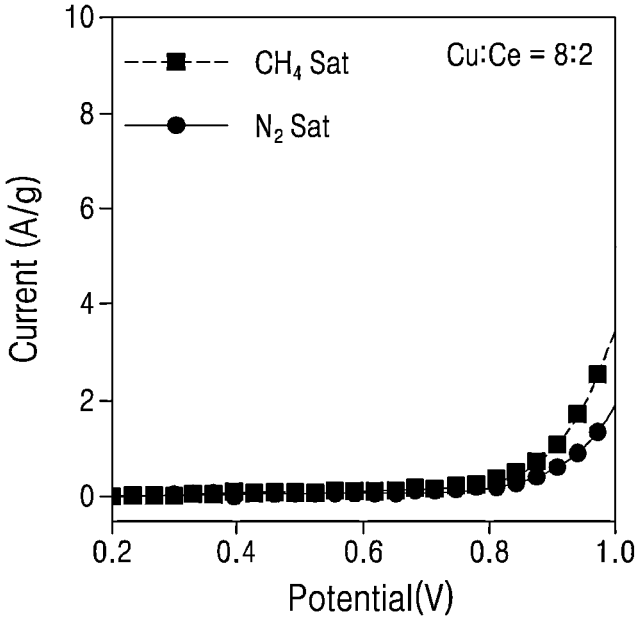
FIG. 12A to FIG. 12C are graphs showing oxidation current analysis results of the catalysts prepared with composition ratios of 8:2, 6:4, and 4:6, respectively, according to a comparative example of the present disclosure at 1.0 V vs. SCE.
Figure 12B:
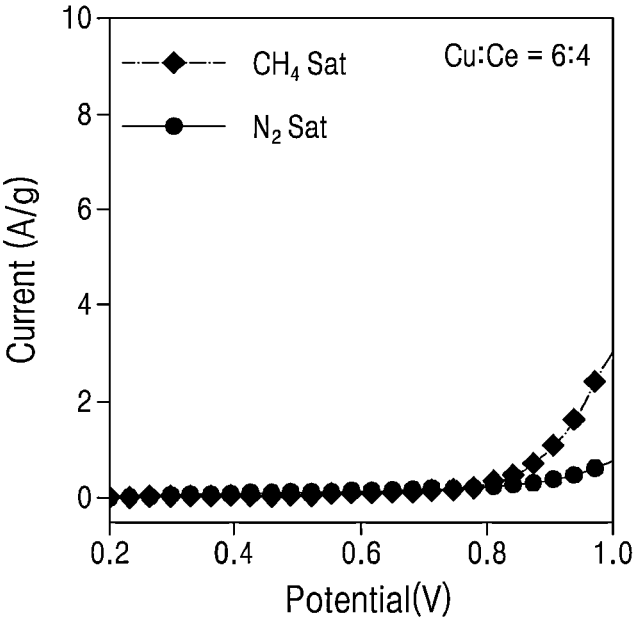
Figure 12C:
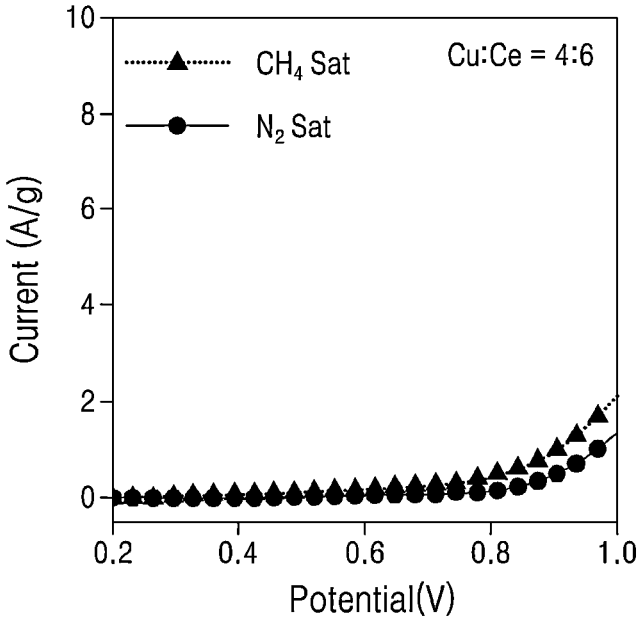

To check the methane oxidation, an oxidation current in a positive direction in which a voltage increases was checked. Referring to FIGS. 12A, 12B, and 12C, as a result of analysis of oxidation current at 1.0 V vs. SCE, the $CuO/CeO_2$ nanoparticle catalyst with a Cu:Ce molar ratio (Comparative Example) has a current density of 3 A/g under electrolyte methane saturation conditions. It can be seen that the current density is lower by 60% than that of the porous $CuO/CeO_2$ nanoparticle catalyst with a Cu:Ce molar ratio of 6:4. Also, it can be seen that in the $CuO/CeO_2$ nanoparticle catalyst with a Cu:Ce molar ratio of 8:2 (Comparative Example) and the $CuO/CeO_2$ nanoparticle catalyst with a Cu:Ce molar ratio of 4:6 (Comparative Example), the current density is lower than that of Example. Accordingly, it can be seen that methane activity is higher under the condition of a controlled internal pore structure, which is because more $CH_4$ active sites are provided.

Test Example 2. Qualitative and Quantitative Analysis of Methane Oxidation Product 1) Qualitative and Quantitative Analysis of Methane Oxidation Product of Porous $CuO/CeO_2$ Nanoparticle Catalyst (Example)

For reaction of methane in liquid phase, 99.999% pure methane was supplied into a 0.5 M $Na_2CO_3$ solution for 1 hour to saturate the solution and an empty space of the reactor was filled with methane. Then, on both sides of the reactor, a cathode was connected to a Pt electrode and an anode was connected to carbon paper on which the catalyst is uniformly loaded. The catalyst was dispersed in water and placed on the carbon paper and then dried. The catalyst was fixed using a binder and then loaded onto an electrode of the carbon paper. The reactor was sealed and cut off from the outside.

By drop-casting the catalyst particle-dispersed solution (0.167 wt % aqueous solution), an electrochemical reactor was constructed using a negative electrode and a positive electrode of a platinum plate on the loaded 10 $cm^2$ graphite foil, and a constant voltage of 1.5 V was applied to the reactor to carry out a methane direct conversion reaction using an electrochemical catalyst. A potential was applied by a silicon solar cell (Minisolar Corp., 66 $cm^2$). A constant voltage was applied by using a power converter build in the laboratory. After 6 hour reaction, 10 mL of an electrolyte was sampled and a methane conversion product was qualitatively and quantitatively analyzed using a gas chromatography-mass spectrometer.

The selectivity was calculated by the ratio between the production of a specific oxygenate product and the production of all oxygenate products. The faradaic efficiency was calculated by the ratio between the quantity of charge used for $CH_4$—$CH_3OH$ conversion and the quantity of charge flowing per unit time.

$$FE_{C_2H_5OH} = \frac{n_{C_2H_5OH} \times N \times F \times 100\%}{I \times t}$$

Here, n is the amount of $CH_3OH$, N is the number of electrons involved in reaction, F is the faradaic efficiency, and I is a current.

Figure 13A:
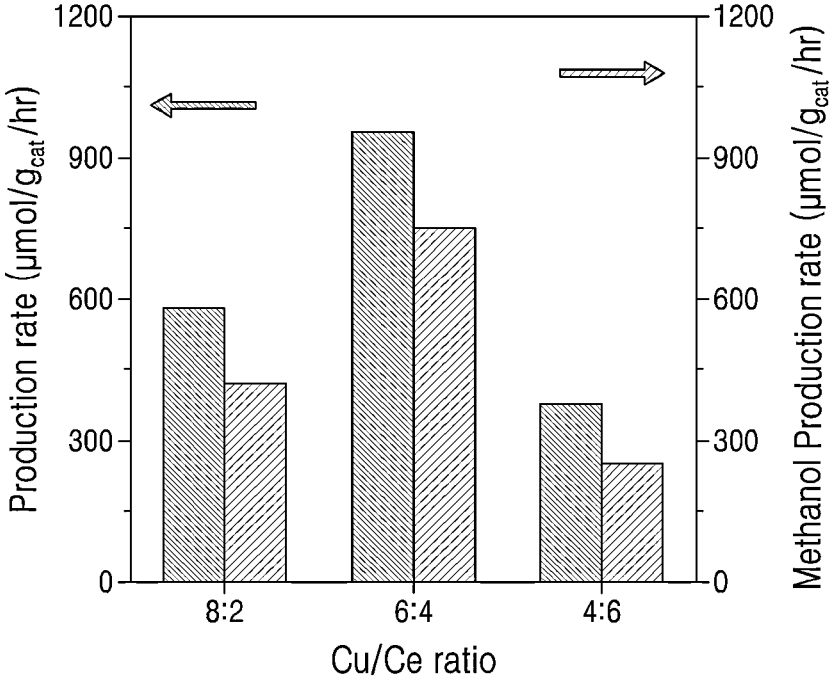
FIG. 13A is a graph showing the methanol production rate (productivity) of the catalysts prepared with composition ratios of 8:2, 6:4, and 4:6, respectively, according to an example of the present disclosure.
Figure 13B:
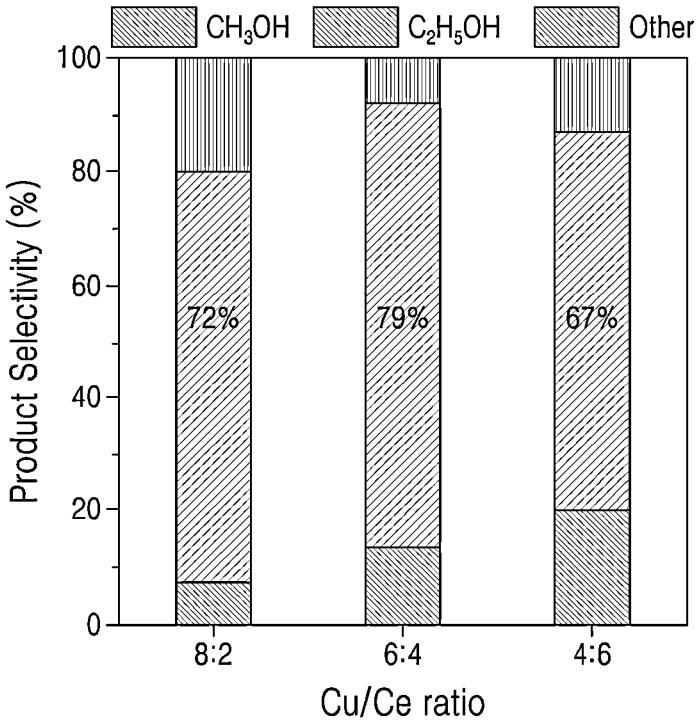
FIG. 13B is a graph showing the methanol selectivity of the catalysts prepared with composition ratios of 8:2, 6:4, and 4:6, respectively, according to an example of the present disclosure.

Through GC-MS analysis after a 6 hour methane conversion reaction of the porous $CuO/CeO_2$ nanoparticle catalyst (Example, spherical) with various molar ratios (8:2, 6:4, or 4:6), it was confirmed that the main product was methanol. FIG. 13A shows the production rates (productivities) of all the oxygenate products contained in $CuO/CeO_2$ with various molar ratios. As can be seen from FIG. 13A, $CuO/CeO_2$ with a Cu:Ce molar ratio of 4:6 shows the highest production rate (left) and the production rate for the total oxygenate product was 958.7 μmol/$g_{cat}$/hr. Also, $CuO/CeO_2$ with a Cu:Ce molar ratio of 6:4 shows the highest production rate (right) of 752.9 μmol/$g_{cat}$/hr for methanol. $CuO/CeO_2$ with a Cu:Ce molar ratio of 8:2, $CuO/CeO_2$ with a Cu:Ce molar ratio of 6:4 and $CuO/CeO_2$ with a Cu:Ce molar ratio of 4:6 show the respective production rates of 422.2 μmol·$g_{cat}^{-1}$·$hr^{-1}$, 752.9 μmol·$g_{cat}^{-1}$·$hr^{-1}$ and 251.1 μmol·$g_{cat}^{-1}$·$hr^{-1}$ for methanol depending on the ratio of catalyst. It can be seen from the result that the $CuO/CeO_2$ catalyst with a Cu:Ce molar ratio of 6:4 shows the highest methane conversion performance and methanol production. Also, it can be seen from FIG. 13B that the selectivities of $CuO/CeO_2$ with a Cu:Ce molar ratio of 8:2, $CuO/CeO_2$ with a Cu:Ce molar ratio of 6:4 and $CuO/CeO_2$ with a Cu:Ce molar ratio of 4:6 for methanol are 72%, 79% and 67%, respectively. The selectivity of $CuO/CeO_2$ with a Cu:Ce molar ratio of 5:5 for methanol was 66%. It can be seen from the above result that the $CuO/CeO_2$ catalyst with a Cu:Ce molar ratio of 6:4 shows the highest selectivity for methanol, and among the by-products, oxygenate products containing a large amount of ethanol ($C_2H_5OH$) and acetone ($CH_3COCH_3$) were observed.

Figure 14A:
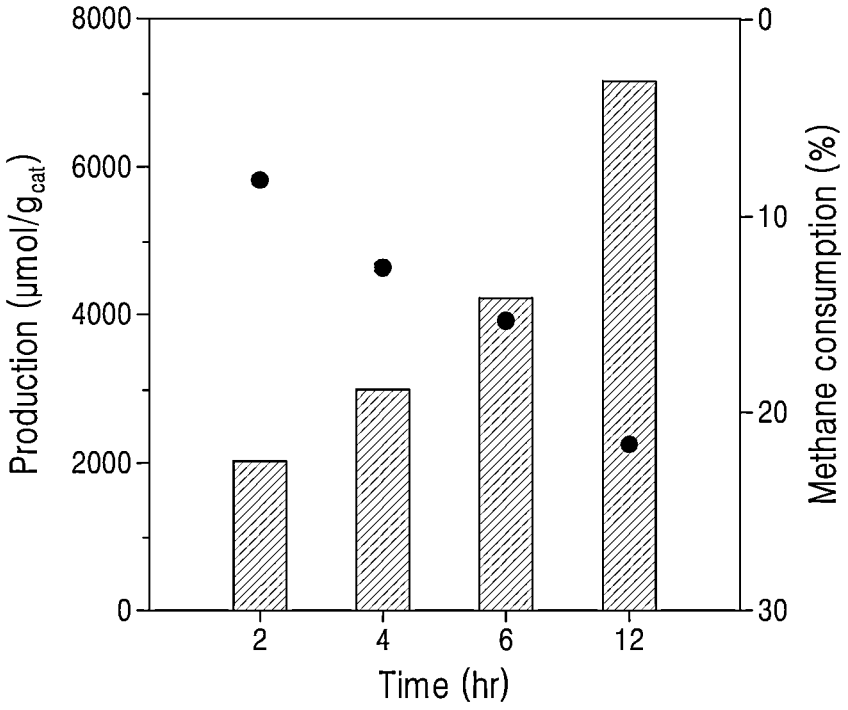
FIG. 14A is a graph showing the production of methanol and the consumption of methane of the catalysts prepared according to an example of the present disclosure over reaction time.
Figure 14B:
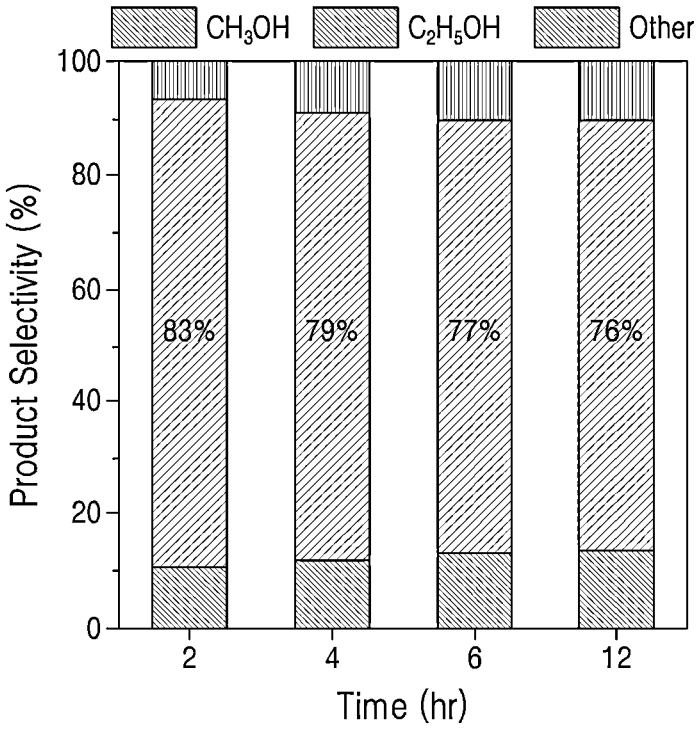
FIG. 14B is a graph showing the selectivity of the catalysts prepared according to an example of the present disclosure for methanol and other oxygenate products for each reaction time.
Figure 15:
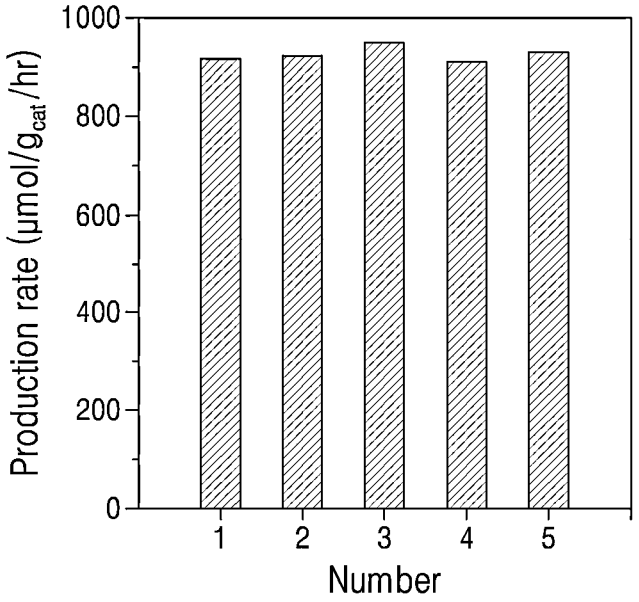
FIG. 15 is a graph showing the production measured as a result of five repetition tests of the catalysts prepared according to an example of the present disclosure.

FIG. 14A shows the production of methanol and the consumption of methane over reaction time, and FIG. 14B shows the selectivity for methanol and other oxygenate products for each reaction time. Referring to FIG. 14A, as for the $CuO/CeO_2$ catalyst with a Cu:Ce molar ratio of 6:4, the production of methanol (red) as a reaction time function gradually increases over reaction time. It can be seen that the production of methanol was 7165.0 μmol/$g_{cat}$ (average conversion rate: 705.1 μmol/$g_{cat}$/hr) at 12 hour point, and gas phase methane in the reactor analyzed by GC was consumed about 22% in a 12 hour reaction, which is identical to the increase rate of the production of methanol. It can be seen that the selectivity for methanol is maintained in the range of from 76% to 83%. FIG. 15 compares the amounts of methanol produced by carrying out a $CH_4$ conversion reaction five times with the $CuO/CeO_2$ catalyst (Cu:Ce=6:4) at the same temperature for the same reaction time of 2 hours. It can be seen from FIG. 15 that an excellent production was maintained without a decrease in the amount of methanol produced in the five repetition tests.

Table 1 shows various catalyst compositions and compares electrochemical methane conversion obtained as a result of 6 hour methane conversion reactions.

TABLE 1

| Entry | Catalyst | Reaction Time (hr) | Production (μmol/$g_{cat}$) $CH_3OH$ | Production (μmol/$g_{cat}$) $C_2H_5OH$ | $CH_3OH$ productivity (μmol/$g_{cat}$/hr) |
|---|---|---|---|---|---|
| 1 | Cu:Ce = 6:4 | 6 | 4517.4 | 791.6 | 752.9 |
| 2 | Cu:Ce = 8:2 | 6 | 2533.2 | 260.0 | 422.2 |
| 3 | Cu:Ce = 4:6 | 6 | 1512.6 | 453.9 | 252.1 |
| 4 | CuO | 6 | 310.6 | 109.6 | 51.8 |

*Room temperature, Atmospheric pressure, Catalyst mass=about 5 mg, Electrolyte pH=12, Applied voltage=1.5 $V_{Pt}$, Potential: potentiostat It can be seen from Table 1 that the porous $CuO/CeO_2$ nanoparticle catalyst with a Cu:Ce molar ratio of 8:2, the porous $CuO/CeO_2$ nanoparticle catalyst with a Cu:Ce molar ratio of 6:4 and the porous $CuO/CeO_2$ nanoparticle catalyst with a Cu:Ce molar ratio of 4:6 are excellent in the production (μmol/$g_{cat}$) and production rate (μmol/$g_{cat}$/hr) of methanol compared to CuO (Comparative Example). Particularly, it can be seen that the $CuO/CeO_2$ catalyst with a Cu:Ce molar ratio of 6:4 shows the highest production and production rate of methanol.

Table 2 compares electrochemical methane conversion obtained as a result of methane conversion reactions carried out for various periods of time in the presence of the porous $CuO/CeO_2$ nanoparticle catalyst with a Cu:Ce molar ratio of 6:4.

TABLE 2

| Entry | Catalyst | Reaction Time (hr) | Production (μmol/$g_{cat}$) $CH_3OH$ | Production (μmol/$g_{cat}$) $C_2H_5OH$ | $CH_3OH$ productivity (μmol/$g_{cat}$/hr) |
|---|---|---|---|---|---|
| 1 | Cu:Ce = 6:4 | 2 | 2019.6 | 249.3 | 1009.8 |
| 2 | Cu:Ce = 6:4 | 4 | 2972.8 | 426.1 | 743.2 |
| 3 | Cu:Ce = 6:4 | 6 | 4230.8 | 705.7 | 705.1 |
| 4 | Cu:Ce = 6:4 | 12 | 7165.0 | 1249.3 | 597.1 |

*Room temperature, Atmospheric pressure, Catalyst mass=about 5 mg, Electrolyte pH=12, Applied voltage=1.5 $V_{Pt}$, Potential: solar cell It can be seen from Table 2 that the porous $CuO/CeO_2$ nanoparticle catalyst with a Cu:Ce molar ratio of 6:4 shows the highest production (μmol/$g_{cat}$) of methanol in a 12 hour reaction, but shows the highest production rate (μmol/$g_{cat}$/hr) of methanol per hour at 2 hour point.

Table 3 compares electrochemical methane conversion obtained as a result of methane conversion reactions carried out at different pressures in the presence of the porous $CuO/CeO_2$ nanoparticle catalyst with a Cu:Ce molar ratio of 6:4.

TABLE 3

| Entry | Catalyst | Reaction Time (hr) | Production (μmol/$g_{cat}$) $CH_3OH$ | Production (μmol/$g_{cat}$) $C_2H_5OH$ | $CH_3OH$ productivity (μmol/$g_{cat}$/hr) | Pressure |
|---|---|---|---|---|---|---|
| 1 | Cu:Ce = 6:4 | 12 | 7165.0 | 1249.3 | 597.1 | atm |
| 2 | Cu:Ce = 6:4 | 12 | 21986.6 | 880.7 | 1832.2 | 10 bar |

*Room temperature, Catalyst mass=about 5 mg, Electrolyte pH=12, Applied voltage=1.5 $V_{Pt}$, Potential: silicon solar cell (750 mW)

It can be seen from Table 3 that the porous $CuO/CeO_2$ nanoparticle catalyst with a Cu:Ce molar ratio of 6:4 shows higher production (μmol/$g_{cat}$) and production rate (μmol/$g_{cat}$/hr) of methanol at 10 bar than at 1 bar in a 12 hour methane conversion reaction, which indicates an improvement of 236% compared to the production under atmospheric pressure.

Figure 16A:
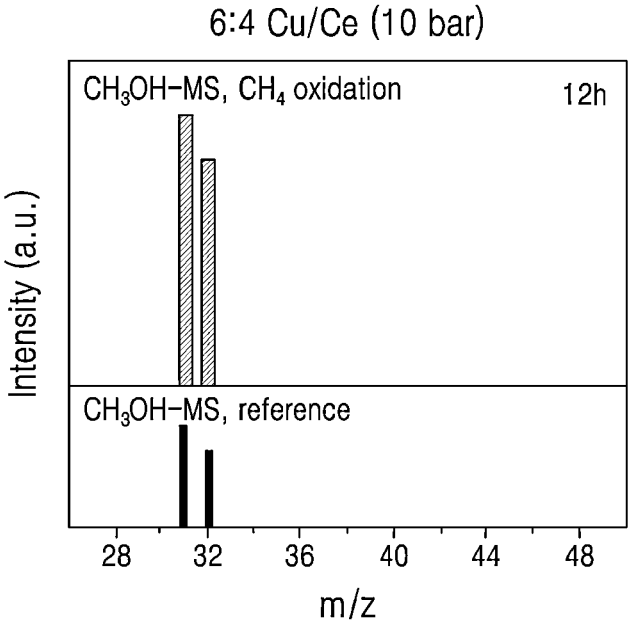
FIG. 16A shows a GC-MS analysis of product obtained by carrying out a methane conversion reaction of the catalyst prepared according to an example of the present disclosure at 10 bar at 12 hour point.
Figure 16B:
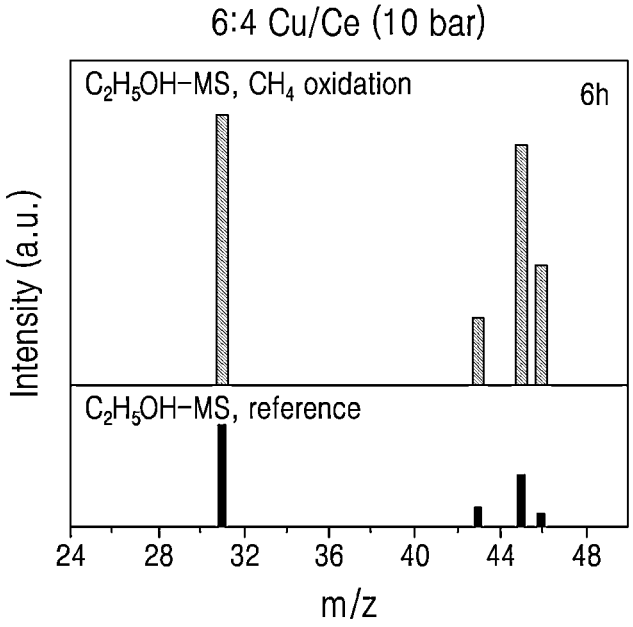
FIG. 16B shows a GC-MS analysis of product obtained by carrying out a methane conversion reaction of the catalyst prepared according to an example of the present disclosure at 10 bar at 6 hour point.

A high-pressure reaction was carried out to increase the solubility of $CH_4$ and then improve the conversion rate, and the result thereof is shown in FIGS. 16A and 16B. FIGS. 16A and 16B show a GC-MS analysis of products obtained by carrying out a methane conversion reaction at 10 bar at 12 hour point and 6 hour point, respectively. The GC-MS result of methanol and ethanol after reaction of the Cu/Ce catalyst at 10 bar can be seen from FIGS. 16A and 16B. Methanol was detected at 31 m/z and 32 m/z, and ethanol was detected at 31 m/z, 43 m/z, 45 m/z and 46 m/z. It can be seen that the produced methanol and ethanol have clear peaks at 31 m/z and 32 m/z and at 31 m/z, 43 m/z, 45 m/z and 46 m/z, respectively, due to low activity of the Cu/Ce catalyst to a methane conversion reaction at 10 bar, which means that methanol and ethanol are detected. The amount of a product obtained by carrying out the methane conversion reaction can be calculated by using the area of a peak of the GC-MS data shown in FIGS. 16A and 16B. The calculation can support the contents of Table 3, i.e., higher production (μmol/$g_{cat}$) and productivity (μmol/$g_{cat}$/hr) of methanol at 10 bar than at 1 bar.

2) Qualitative and Quantitative Analysis of Methane Oxidation Product of $Cuo/Ceo_2$ Nanoparticle Catalyst (Comparative Example)

A methane conversion product of the $CuO/CeO_2$ nanoparticle catalyst (Comparative Example) was qualitatively and quantitatively analyzed using a gas chromatography-mass spectrometer in the same manner as in Test Example 2-1.

Figure 17A:
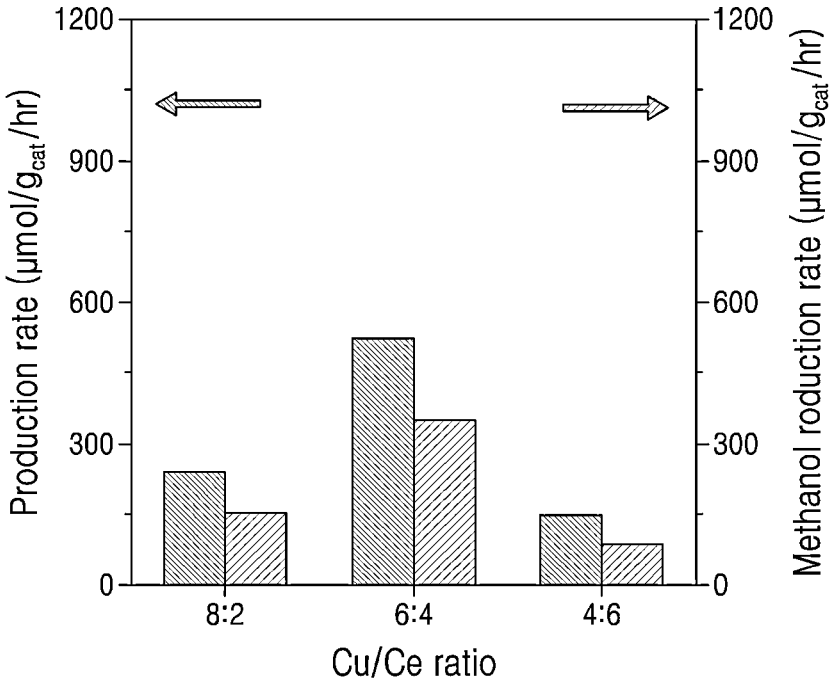
FIG. 17A is a graph showing the production of methanol and the consumption of methane of the catalysts prepared with composition ratios of 8:2, 6:4, and 4:6, respectively, according to a comparative example of the present disclosure over reaction time.
Figure 17B:
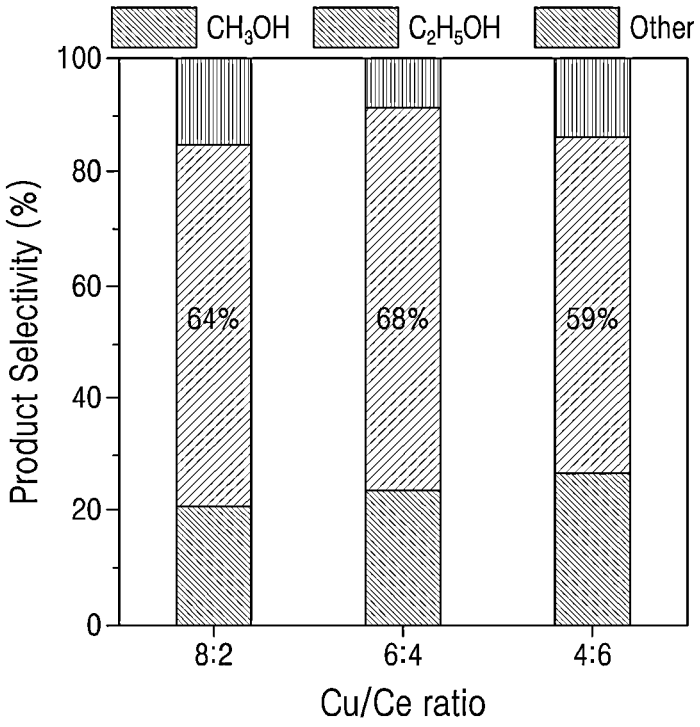
FIG. 17B is a graph showing the selectivity of the catalysts prepared with composition ratios of 8:2, 6:4, and 4:6, respectively, according to a comparative example of the present disclosure for methanol and other oxygenate products for each reaction time.

Through GC-MS analysis after a 6 hour methane conversion reaction of the $CuO/CeO_2$ nanoparticle catalyst (Comparative Example) with various molar ratios (8:2, 6:4, or 4:6), it was confirmed that the main product was methanol. As can be seen from FIG. 17A, $CuO/CeO_2$ with a Cu:Ce molar ratio of 8:2, $CuO/CeO_2$ with a Cu:Ce molar ratio of 6:4 and $CuO/CeO_2$ with a Cu:Ce molar ratio of 4:6 show the respective highest production rates (right) of 153.3 $\mu mol \cdot g_{cat}^{-1} \cdot hr^{-1}$, 355.1 $\mu mol \cdot g_{cat}^{-1} \cdot hr^{-1}$ and 87 $\mu mol \cdot g_{cat}^{-1} \cdot hr^{-1}$ for methanol depending on the ratio of catalyst. It can be seen from the result that the high production rate of the $CuO/CeO_2$ particle catalyst with a Cu:Ce molar ratio of 6:4 is lower by 50% than that of the porous $CuO/CeO_2$ nanoparticle catalyst (Example, spherical) with a Cu:Ce molar ratio of 6:4. Also, it can be seen from FIG. 17B that the selectivities of $CuO/CeO_2$ with a Cu:Ce molar ratio of 8:2, $CuO/CeO_2$ with a Cu:Ce molar ratio of 6:4 and $CuO/CeO_2$ with a Cu:Ce molar ratio of 4:6 for methanol are 64%, 68% and 59%, respectively, and are lower by 8%, 11% and 8% than those of the porous $CuO/CeO_2$ nanoparticle catalysts (Example). Thus, it can be seen that the porous $CuO/CeO_2$ nanoparticle catalysts (Example) have higher selectivity for $CuO/CeO_2$.

Test Example 3. Methane Conversion Reactor Connected to Solar Cell

Figure 18A:
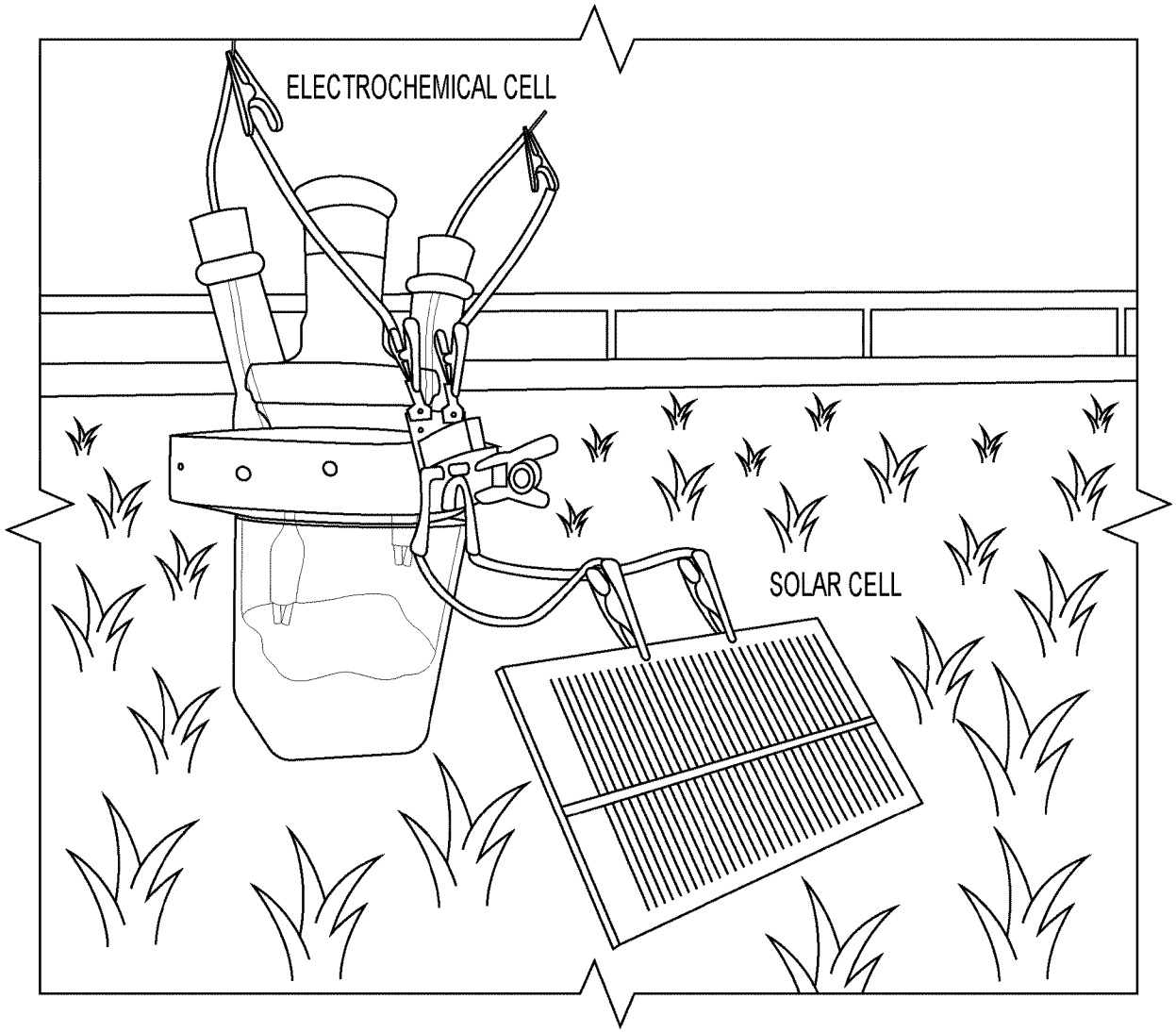
FIG. 18A is a photo of a tandem system of a silicon solar cell and an electrochemical reactor according to an example of the present disclosure.
Figure 18B:
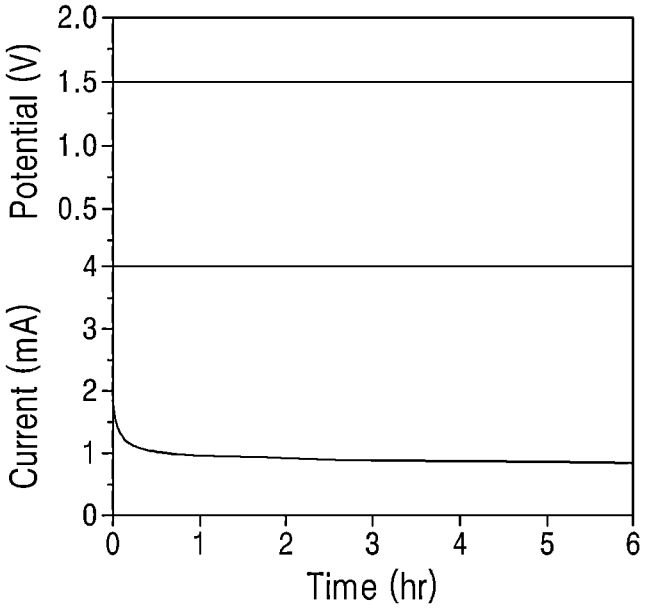
FIG. 18B is a graph showing voltages and currents generated from a solar cell under one sun over time according to an example of the present disclosure.

For application of a powerless methane conversion system, a methane conversion reactor was connected to a silicon solar cell, and a tandem reactor equipped with the silicon solar cell was used to demonstrate the $CH_4$—$CH_3OH$ conversion. This can apply a voltage required for reaction with just sunlight. Also, in order to maintain 1.5 V which is the optimal voltage for reaction, a power converter was used to apply a constant voltage of 1.5 V to the reaction system. Voltages and currents over reaction time were checked. FIG. 18A shows a tandem system of a silicon solar cell and an electrochemical reactor, and FIG. 18B shows voltages and currents generated from a solar cell under one sun over time. Here, the voltage output from the solar cell was made constant at 1.5 V by the power converter, and the current was stably maintained even after 30 minutes and only about 1 mA was consumed.

As a result, it can be seen from Table 4 below that the production rate (productivity) of methanol and the selectivity for methanol are excellent compared to those of conventional catalysts. In Table 4, Compositions 1 to 3 produce methanol by using heat and are excellent in the selectivity for methanol but not in the production rate of methanol. Compositions 4 and 5 are used as photocatalysts to produce methanol and are also excellent in the selectivity for methanol but not in the production rate of methanol. Composition 6 produces ethanol. Meanwhile, the catalyst of the present disclosure is used as an electrocatalyst and shows an excellent production rate of methanol with a high selectivity of 85% or more for methanol.

TABLE 4

| Composition | Catalyst | $CH_3OH$ activity | $CH_3OH$ productivity (μmol/$g_{cat}$/hr) | $CH_3OH$ selectivity (%) | Reaction condition | Ref. |
|---|---|---|---|---|---|---|
| 1 | Fe-ZSM-5@ZIF-8 | Heat | 18.6 | 100 | 150° C., | |
| 2 | $IrO_2/CuO$ | Heat | 645.6 | 95 | 150° C., 20 bar | |
| 3 | Cu-Erionite Zeolite | Heat | 147 | 87 | 300° C., 36 bar | |
| 4 | $FeO_x/TiO_2$ | Photocatalysis | 366.6 | 90 | 25° C., 1 bar | |
| 5 | Au/ZnO | Photocatalysis | 685.5 | 100 | 30° C., 15 bar | |
| 6 | NiO/Ni | Electrocatalysis | 25 (ethanol) | 87 | 25° C., 1 bar | |

TABLE 4-continued

| Composition | Catalyst | $CH_3OH$ activity | $CH_3OH$ productivity ($\mu mol/g_{cat}/hr$) | $CH_3OH$ selectivity (%) | Reaction condition | Ref. |
|---|---|---|---|---|---|---|
| 7 | $CuO/CeO_2$ | Electrocatalysis | 1971.8 | 86 | 25° C., 10 bar | Present disclosure |

What is claimed is:

1. A porous nanoparticle catalyst for methane conversion, comprising, a first metal oxide and a second metal oxide, wherein the first metal oxide includes CuO, wherein the second metal oxide includes $CeO_2$, wherein the porous nanoparticle catalyst is a porous $CuO/CeO_2$ nanoparticle catalyst and a size of the porous $CuO/CeO_2$ nanoparticle catalyst based on a single particle diameter is 0.3 μm to 1.5 μm, and wherein the porous $CuO/CeO_2$ nanoparticle catalyst includes pores formed using glycerin.

2. The porous nanoparticle catalyst for methane conversion of claim 1, wherein a molar ratio of the first metal oxide: the second metal oxide is 8:2 to 4:6.

3. The porous nanoparticle catalyst for methane conversion of claim 1, wherein the first metal oxide, the second metal oxide, and an oxygen are uniformly dispersed.

4. The porous nanoparticle catalyst for methane conversion of claim 1, wherein a specific surface area of the porous nanoparticle catalyst for methane conversion is 30 $m^2/g$ to 60 $m^2/g$.

5. The porous nanoparticle catalyst for methane conversion of claim 1, wherein the porous nanoparticle catalyst is configured to convert a methane to at least one of the products selected from methanol, ethanol, 1-propanol, 2-propanol, and acetone.

6. The porous nanoparticle catalyst for methane conversion of claim 5, wherein a selectivity of the methanol among the products is 65% or more.

7. The porous nanoparticle catalyst for methane conversion of claim 5, wherein a productivity of the methanol is 200 $\mu mol/g_{cat}/hr$ to 2000 $\mu mol/g_{cat}/hr$.

8. The porous nanoparticle catalyst for methane conversion of claim 1, wherein the methane conversion is carried out at a room temperature.

9. The porous nanoparticle catalyst for methane conversion of claim 1, wherein the methane conversion is carried out at a pressure of 1 bar to 15 bar.

10. The porous nanoparticle catalyst for methane conversion of claim 1, wherein the methane conversion is carried out using a solar cell.

11. A method of preparing the porous nanoparticle catalyst for methane conversion according to claim 1, comprising:

dissolving a first metal precursor and a second metal precursor in an alcohol and performing a first heat treatment in the presence of glycerin to obtain a metal mixture; and washing the metal mixture with an organic solvent and performing a second heat treatment for removing the glycerin to obtain the porous nanoparticle catalyst for methane conversion.

12. The method of claim 11, wherein the first heat treatment is performed at 150° C. to 200° C.

13. The method of claim 11, wherein the first heat treatment is performed for 5 hours to 10 hours.

14. The method of claim 11, wherein the second heat treatment is performed at 300° C. to 400° C.

15. The method of claim 11, wherein the second heat treatment is performed for 1 hour to 5 hours.

16. A catalyst electrode, comprising the porous nanoparticle catalyst for methane conversion according to claim 1.

* * * * *